US008178773B2

(12) United States Patent
Riopelle et al.

(10) Patent No.: US 8,178,773 B2
(45) **Date of Patent: *May 15, 2012**

(54) SYSTEM AND METHODS FOR THE CREATION AND PERFORMANCE OF ENRICHED MUSICAL COMPOSITION

(75) Inventors: Gerald Henry Riopelle, Scottsdale, AZ (US); Gary Bencar, Holualoa, HI (US)

(73) Assignee: Beamz Interaction, Inc., Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/586,885

(22) Filed: Sep. 29, 2009

(65) Prior Publication Data

US 2010/0107855 A1 May 6, 2010

Related U.S. Application Data

(60) Continuation-in-part of application No. 11/075,748, filed on Mar. 10, 2005, now Pat. No. 7,858,870, which is a division of application No. 11/112,004, filed on Apr. 22, 2005, now Pat. No. 7,504,577, and a continuation-in-part of application No. 10/218,821, filed on Aug. 16, 2002, now Pat. No. 6,960,715.

(60) Provisional application No. 60/551,329, filed on Mar. 10, 2004, provisional application No. 60/312,843, filed on Aug. 16, 2001, provisional application No. 61/209,680, filed on Mar. 10, 2009, provisional application No. 61/271,047, filed on Jul. 16, 2009.

(51) Int. Cl.
*G10H 3/00* (2006.01)

(52) U.S. Cl. ..... 84/723; 84/735; 84/737; 84/738

(58) Field of Classification Search ..... None
See application file for complete search history.

(56) References Cited

U.S. PATENT DOCUMENTS

| | | | | |
|---|---|---|---|---|
| 4,526,078 | A * | 7/1985 | Chadabe | 84/602 |
| 4,716,804 | A * | 1/1988 | Chadabe | 84/653 |
| 5,739,457 | A * | 4/1998 | Devecka | 84/743 |
| 6,268,557 | B1 * | 7/2001 | Devecka | 84/743 |
| 6,369,313 | B2 * | 4/2002 | Devecka | 84/743 |
| 6,492,775 | B2 * | 12/2002 | Klotz et al. | 315/120 |
| 6,835,887 | B2 * | 12/2004 | Devecka | 84/743 |
| 6,960,715 | B2 * | 11/2005 | Riopelle | 84/725 |
| 7,223,913 | B2 * | 5/2007 | Knapp et al. | 84/722 |
| 7,402,743 | B2 * | 7/2008 | Clark et al. | 84/615 |
| 7,446,253 | B2 * | 11/2008 | Knapp et al. | 84/722 |
| 7,504,577 | B2 * | 3/2009 | Riopelle | 84/723 |
| 7,709,723 | B2 * | 5/2010 | Pachet et al. | 84/603 |
| 7,858,870 | B2 * | 12/2010 | Riopelle | 84/622 |
| 2002/0121181 | A1 * | 9/2002 | Fay et al. | 84/609 |
| 2005/0241466 | A1 * | 11/2005 | Riopelle | 84/725 |
| 2006/0107826 | A1 * | 5/2006 | Knapp et al. | 84/724 |

* cited by examiner

*Primary Examiner* — Marlon Fletcher
(74) *Attorney, Agent, or Firm* — Robert C. Klinger

(57) ABSTRACT

A System and method for the creation and performance of enriched musical composition. One aspect of the invention allows a composer to associate content with one or more triggers, and to define behavior characteristics that control the functioning of each trigger. Another aspect of the invention provides a variety of user interfaces through which a performer can cause content to be presented to an audience.

40 Claims, 24 Drawing Sheets

FIG. 14

1400

| SONG SECTIONS: | 1. INTRO | 2. VERSE | 3. CHORUS | 4. BREAK | 5. VERSE | 6. CHORUS | 7. ENDING |
|---|---|---|---|---|---|---|---|
| LENGTH: | 1 BAR | 8 BARS | 8 BARS | 4 BARS | 8 BARS | 8 BARS | 2 BARS |
| MUSIC PARTS: | RIFF-I | RIFF-V | RIFF-C | RIFF-B | RIFF-V | RIFF-C | RIFF-E |

START

SONG IS 39 BARS LONG AND HAS 7 SECTIONS

STOP

FIG. 15

1500

| SONG SECTION: | 1. INTRO | 2. VERSE | 3. CHORUS | 4. BREAK | 5. VERSE | 6. CHORUS | 7. ENDING |
|---|---|---|---|---|---|---|---|
| LENGTH: | 1 BAR | 8 BARS | 8 BARS | 4 BARS | 8 BARS | 8 BARS | 2 BARS |
| MUSIC PART: | RIFF-I | RIFF-V | RIFF-C | RIFF-B | RIFF-V | RIFF-C | RIFF-E |
| **PIANO** PART: | PIANO-I | PIANO-V | PIANO-C | PIANO-B | PIANO-V | PIANO-C | PIANO-E |
| **GUITAR** PART: | GUITAR-I | GUITAR-V | GUITAR-C | GUITAR-B | GUITAR-V | GUITAR-C | GUITAR-E |
| **BASS** PART: | BASS-I | BASS-V | BASS-C | BASS-B | BASS-V | BASS-C | BASS-E |
| **DRUMS** PART: | DRUMS-I | DRUMS-V | DRUMS-C | DRUMS-B | DRUMS-V | DRUMS-C | DRUMS-E |

MUSIC CLIPS

MUSIC CLIPS

1700

FREE RUNNING SECTION IS ACTIVE WHEN NO RHYTHM MASTER IS PLAYING

SONG SECTIONS ARE PLAYED AND CONTROLLED BY THE RHYTHM MASTER. AS THE MASTER PLAYS THROUGH EACH SECTION, THE *MUSIC CLIPS* FOR THE CURRENT SECTION BECOME ACTIVE AND AVAILABLE FOR THE PERFORMER TO PLAY ON EACH INSTRUMENT. THIS IS DONE BY TRIGGERING A *BEAM* THAT HAS BEEN ASSIGNED TO A BEAMZ *INSTRUMENT*

WHEN THE MASTER IS STOPPED THE FREE RUNNING SECTION BECOMES ACTIVE AND ALL ENDING SECTION'S MUSIC CLIPS AUTOMATICALLY PLAY

| SECTION: | **FREE RUN** | **1. INTRO** | **2. VERSE** | **3. CHORUS** | **4. BREAK** | **5. VERSE** | **6. CHORUS** | **-ENDING-** |
|---|---|---|---|---|---|---|---|---|
| LENGTH: | N/A | 1 BAR | 8 BARS | 8 BARS | 4 BARS | 8 BARS | 8 BARS | N/A |
| MUSIC: | RIFF-F | RIFF-I | RIFF-V | RIFF-C | RIFF-B | RIFF-V | RIFF-C | RIFF-E |
| **PIANO**: | PIANO-F | PIANO-I | PIANO-V | PIANO-C | PIANO-B | PIANO-V | PIANO-C | PIANO-E |
| **GUITAR**: | GUITAR-F | GUITAR-I | GUITAR-V | GUITAR-C | GUITAR-B | GUITAR-V | GUITAR-C | GUITAR-E |
| **BASS**: | BASS-F | BASS-I | BASS-V | BASS-C | BASS-B | BASS-V | BASS-C | BASS-E |
| **DRUMS**: | DRUMS-F | DRUMS-I | DRUMS-V | DRUMS-C | DRUMS-B | DRUMS-V | DRUMS-C | DRUMS-E |

FIG. 17

SYSTEM AND METHODS FOR THE CREATION AND PERFORMANCE OF ENRICHED MUSICAL COMPOSITION

PRIORITY CLAIM

This application claims priority of U.S. Provisional Application Serial No. 61/209,680, filed Mar. Ser. No. 10, 2009 entitled "Interactive Music Composer" and of U.S. Provisional Application Serial No. 61/271,047, filed Jul. 16, 2009 entitled "System and Methods for the Creation and Performance of Enriched Musical Composition" the teaching of which are incorporated herein by reference.

This application is a Continuation-in-Part of, and claims priority of U.S. patent application Ser. No. 11/075,748, filed Mar. 10, 2005 now U.S. Pat. No. 7,858,870, entitled "System and Methods for the Creation and Performance of Sensory Stimulating Content," and which claimed priority of U.S. Provisional Patent Application Ser. No. 60/551,329, filed Mar. 10, 2004, entitled "Music Instrument System and Method", which application has a divisional application being U.S. patent application Ser. No. 11/112,004, filed Apr. 22, 2005 entitled MUSIC INSTRUMENT SYSTEM AND METHODS now issued as U.S. Pat. No. 7,504,577, and which application Ser. No. 11/075,748 is a Continuation-in-Part of U.S. patent application Ser. No. 10/218,821 filed Aug. 16, 2002, entitled Music Instrument System and Methods, now Issued U.S. Pat. No. 6,960,715 and which claimed priority of U.S. Provisional Patent Application Ser. No. 60/312,843, filed Aug. 16, 2001, entitled "Pulsed Beam Mode Enhancements". The teachings of these applications are incorporated herein by reference in their entirety, including all appendices.

FIELD OF THE INVENTION

This invention relates to the composition and performance of sensory stimulating content, such as, but not limited to, sound and video content. More specifically, the invention includes a system through which a composer can pre-package certain sensory stimulating content for use by a performer. Another aspect of the invention includes an apparatus through which the performer can trigger and control the presentation of the pre-packaged sensory stimulating content. A common theme for both the composer and the performer is that the pre-packaged sensory stimulating content is preferably chosen such that, even where the performer is a novice, the sensory stimulating data is presented in a pleasing and sympathetic manner.

SUMMARY OF THE INVENTION

The present invention allows a composer to arrange and package sensory stimulating content, or commands therefor, into "programs" for use by a performer. To simplify the description of the invention, reference will be primarily made to sensory stimulating content in the form of sounds and/or images. By way of example, without intending to limit the present invention, a program may contain one or more sound recordings, and/or one or more Musical Instrument Digital Interface ("MIDI") files. Unlike traditional sound recordings, MIDI files contain information about the sound to be generated, including attributes like key velocity, pitch bend, and the like. As such, a MIDI file may be seen as one or more commands for generating sensory stimulating content, rather than the content itself. Similarly, in a visually-enabled embodiment, a program may include still images, motion pictures, commands for presenting a still or motion picture, and the like. By way of example, without intending to limit the present invention, a program may include a three dimensional ("3D") model of a person, and movement and other characteristics associated with that model. Such a model can be seen as commands for generating the visual content, rather than the content itself While the description herein focuses primarily on auditory-oriented and visually-oriented content, the present invention should not be interpreted as limited to content with only visual and audio stimuli. Instead, it should be appreciated by one skilled in the art that the spirit and scope of the invention encompasses any sensory stimulating content, including scents, tastes, or tactile stimulation. By way of example, without intending to limit the present invention, a program may include instructions to trigger the release of a particular scent into the air using the scented bolus technology developed by MicroScent LLC of Menlo Park, Calif. and described in U.S. Pat. No. 6,357,726 to Watkins, et al., and U.S. Pat. No. 6,536,746, to Watkins, et al., the teachings of which are incorporated herein by reference in their entirety, or the teachings of U.S. Pat. No. 6,024,783, to Budman, which are incorporated herein in their entirety. Similarly, a program may include instructions to vibrate the seats in which the audience is sitting using a Bass Shaker, manufactured by Aura Sound, Inc. of Santa Fe Springs, Calif., or the ButtKicker line of tactile transducers manufactured by The Guitammer Company, Inc. of Westerville, Ohio, as described in U.S. Pat. No. 5,973,422 to Clamme, or to provide other tactile stimulation.

Each program preferably includes a plurality of segments of sensory stimulating content, as chosen and/or written by a composer. In an auditory-enabled embodiment, such content segments may include, but are not limited to, the above-described MIDI files and sound recordings. In a preferred embodiment, each program's content is selected such that the different segments, when presented to an audience, are sympathetic. U.S. patent application Ser. No. 10/219,821, the contents of which are incorporated herein by reference in their entirety, provides a detailed description of an auditory sympathetic program. It should be apparent to one skilled in the art that this concept can be applied to other types of content as well. By way of example, without limitation, in a visually-enabled embodiment, the color palette associated with still or motion images may be selected such that the colors, and/or the images as a whole, do not visually clash with each other.

The composer can also divide one or more programs into "songs". By way of example, without intending to limit the present invention, a song may include content for a "chorus" section, and separate content for a "verse" section. The present invention allows composers and/or performers to determine the point at which the song transitions from one content to another within each song, based on such factors as a presentation interval associated with the content, the performer activating one or more triggers, or the like. Again, although the terms used throughout this specification focus on auditory content, the terms are not intended to limit the invention to only auditory content. By way of example, the chorus section may include one set of still or motion images and scents, and the verse section may include a different set of still or motion images and scents.

Within each program, the composer preferably selects at least one content segment to serve as background content. By way of example, without intending to limit the present invention, in an auditory-enabled embodiment, the composer may select a series of sounds and/or rhythms which are intended to underlie a performance, such as a looped drum track. The remaining content segments can be assigned by the composer and/or performer to one or more triggers, as defined below.

Once a program has been created, a performer can utilize a program or set of programs as the basis for a performance. Unlike traditional music or other performances, wherein it is generally the performer's goal to accurately and consistently reproduce the content, the present invention gives the performer the freedom to innovate and create new and unique performances using the same program. For example, the performer can control the timing with which some or all content segments are presented to the audience, can transpose the content, and otherwise control the performance.

The performer causes content playback to begin by activating one of a plurality of triggers associated with the system. Such triggers may include, but are not limited to, one or more user interface elements on a computer screen; a key on a computer keyboard, number pad, touch screen, joy stick, or the like; a key on a musical keyboard, string on a guitar, or the like; a MIDI-generated trigger from a MIDI controller; and environmental monitors, such as microphones, light sensors, strain gauges, or the like. In general, activating a specific trigger will cause the content selected by the composer as background content to be presented.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 14 is an example of a traditional sample song;

FIG. 15 is an example of a traditional sample song with instruments added;

FIG. 17 is an example of a Beamz sample song with descriptions for each section;

DETAILED DESCRIPTION OF THE PREFERRED EMBODIMENTS OF THE PRESENT INVENTION

As described above, the present invention allows a composer to pre-package content which is used by a performer to present the content to an audience. To cause content to be presented, the performer activates one of a plurality of triggers.

Figure 1:
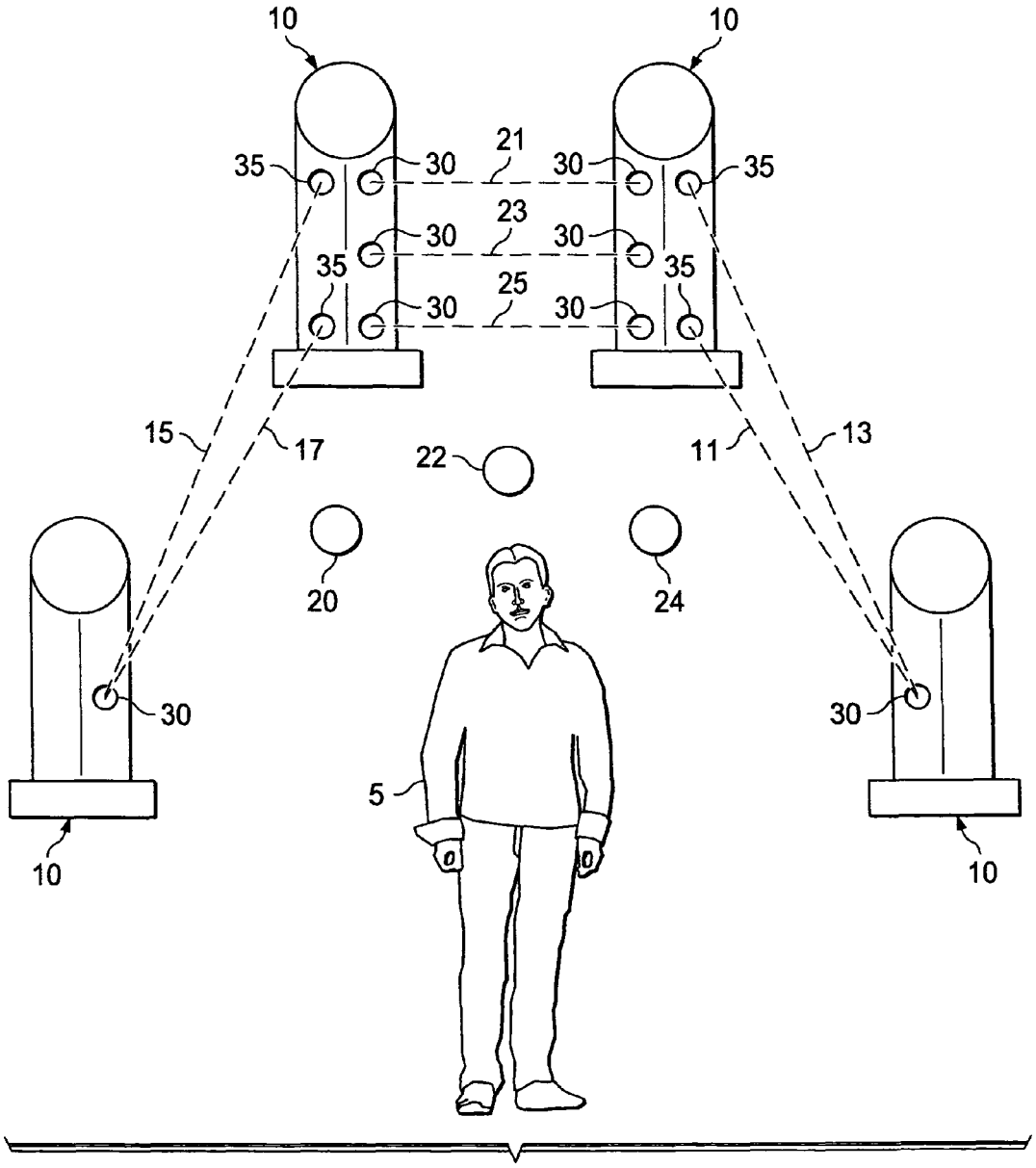
FIG. 1 is a block diagram of a content presentation user interface.

FIG. 1 is a block diagram of one embodiment of a content presentation user interface. In FIG. 1, block 5 represents the performer. In the illustrated embodiment, the performer stands between posts 10, and is surrounded on three sides by light beams 11, 13, 15, 17, 21, 23, and 25. Light emitters 30 generate the light beams, and the light beams are preferably aimed at light detectors 35. Light detectors 35 are attached to, or embedded in, posts 10, and each serves as a trigger for the system. The three foot switches, blocks 20, 22, and 24, represent additional triggers that are available to the performer. Each time the performer breaks light beams 11 or steps on foot switches 20, 22, or 24, this activates the trigger associated with the light beam or switch. A corresponding signal is then sent to a computer, synthesizer, scent generator, or other such device, and causes the presentation of content associated with the activated trigger.

Figure 2:
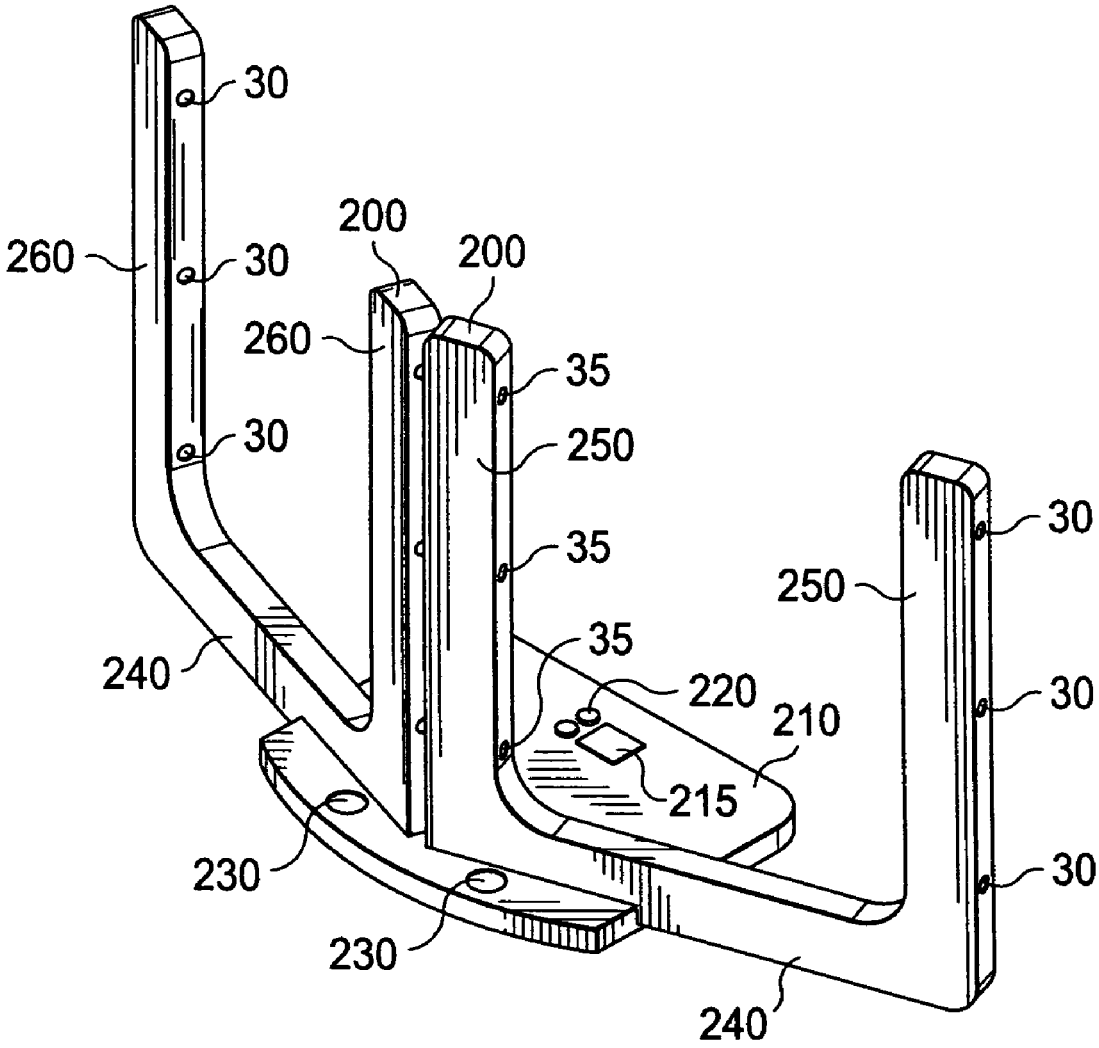
FIG. 2 is a rear perspective view of a portable, table-top content presentation user interface.
Figure 3:
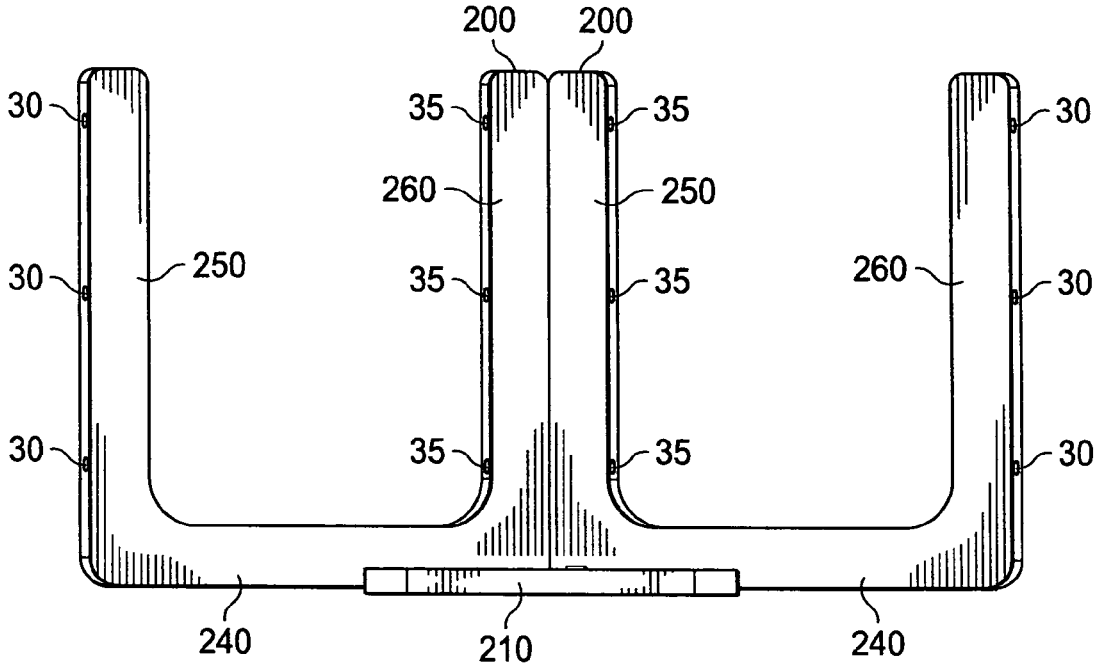
FIG. 3 is a front plan view of the portable, table-top content presentation user interface of FIG. 2.
Figure 4:
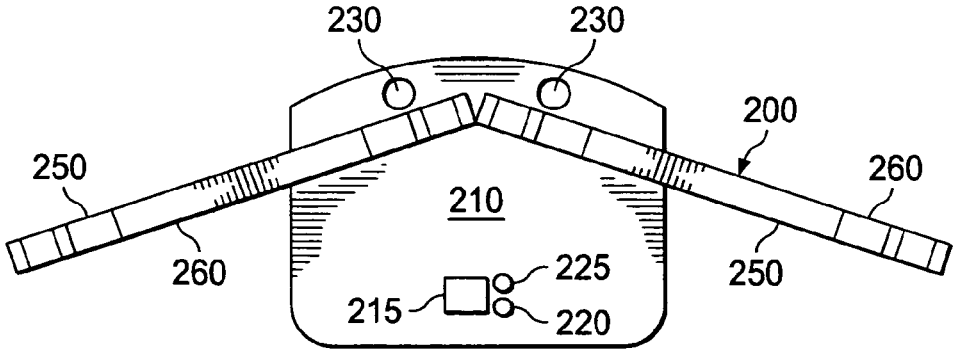
FIG. 4 is a top plan view of the portable, table-top content presentation user interface of FIG. 2.

FIG. 2 is a rear perspective view of a portable, table-top content presentation user interface. FIG. 3 is a front plan view of the portable, table-top content presentation system illustrated in FIG. 2. FIG. 4 is a top plan view of the portable, table-top content presentation system illustrated in FIG. 2. In FIGS. 2-4, corresponding components are similarly labeled for clarity. In the embodiment illustrated in FIGS. 2-4, light emitters 30 and light detectors 35 are preferably embedded within each arm (250, 260) of "U" shaped members 200, thereby simplifying aiming of the light beams and reducing the likelihood that the emitters or detectors will be misaligned during transport.

Members 200 can be easily attached to base 210 by inserting base 240 of members 200 into an appropriately sized groove in base 210. This allows base 210 to support members 200; places members 200 at a comfortable, consistent angle; and allows members 200 to be electronically connected to base 210 via cables (not illustrated) that plug into ports 230.

Base 210 also preferably includes switches 220 and 225, and a display 215. Switches 220 and 225 can be configured to allow a performer to switch from program to program, or from segment to segment within a program; adjust the intensity with which the content is presented; adjust the tempo or pitch at which content is presented; start or stop recording of a given performance; and other such functions. Display 215 can provide a variety of information, including the program name or number, the segment name or number, the current content presentation intensity, the current content presentation tempo, or the like.

When the embodiment illustrated in FIG. 2 is active, light emitters 30 generate light beams which are detected by light detectors 35. Each time the performer breaks the light beams or activates one of switches 220 or 225, the trigger associated with the light beam or switch is activated. In one embodiment, a corresponding signal is sent to a computer, synthesizer, scent generator, or other such device via a Universal Serial Bus (USB) or other such connection. Such a signal causes the device to present the content associated with the activated trigger.

In an alternative embodiment, base 210 and/or members 200 may also contain one or more speakers, video displays, or other content presentation devices, and one or more data storage devices, such that the combination of base 210 and members 200 provide a self-contained content presentation unit. In this embodiment, as the performer activates the triggers, base 210 can cause the content presentation devices to present the appropriate content to the audience. This embodiment can also preferably be configured to detect whether additional and/or alternative content presentation devices are attached thereto, and to trigger those in addition to, or in place of, the content presentation device(s) within the content presentation unit.

Figure 10:
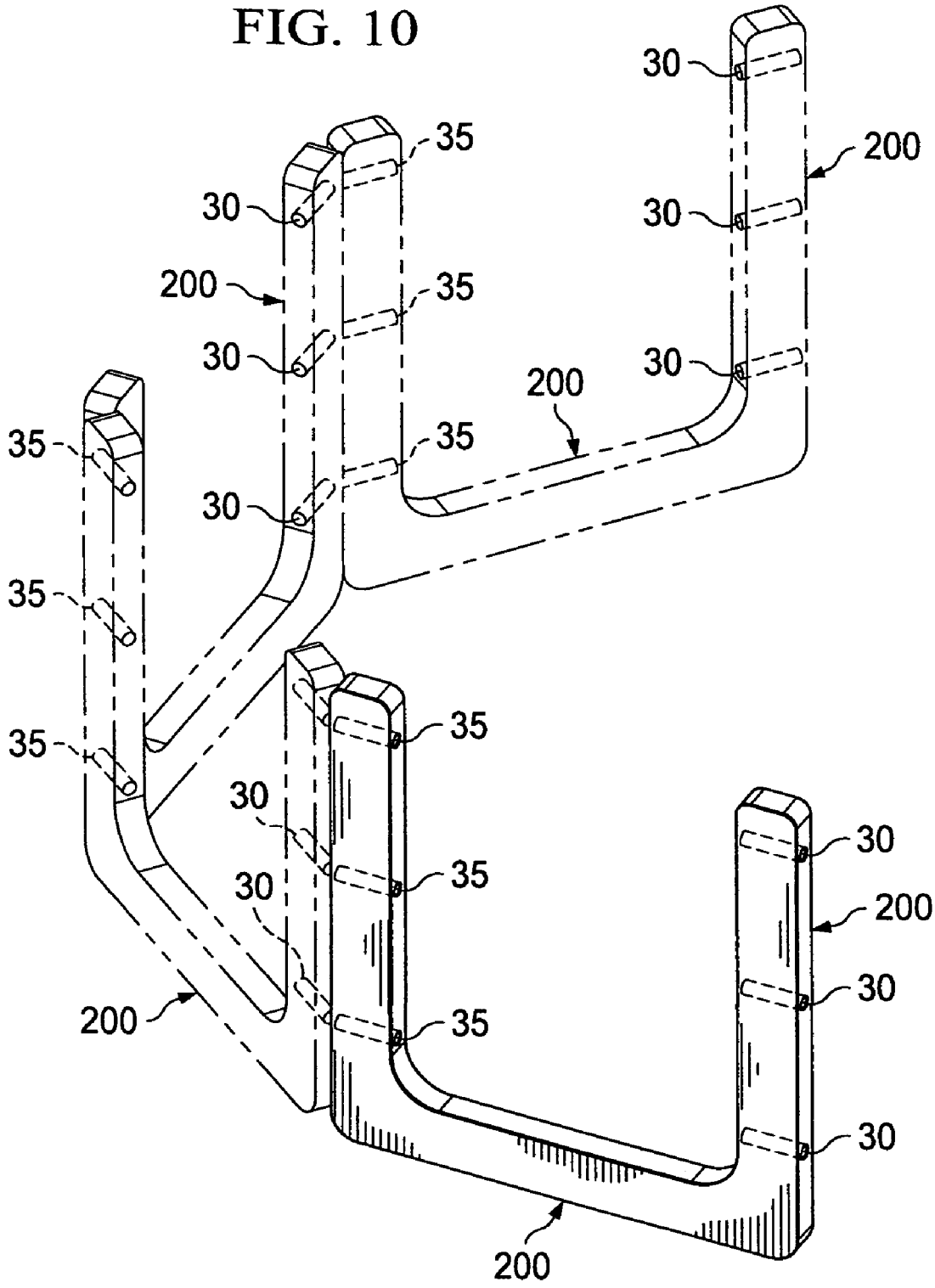
FIG. 10 is a perspective view of an alternative content presentation user interface embodiment.

FIG. 10 illustrates still another content presentation user interface embodiment. In this embodiment, a plurality of "U" shaped members 200 are attached to each other, thereby obviating the need for a base and increasing the number of triggers associated with the user interface. Because a preferred embodiment utilizes clear material for members 200, the additional members 200 are illustrated in phantom for clarity. This embodiment readily allows a plurality of content presentation devices to be attached to each other, and positioned at varying angles with respect to each other. By way of example, without intending to limit the present invention, such an embodiment can allow multiple performers to create content presentations together using a single user interface, or allow a performer to increase the number of triggers available for a given performance.

Although the description provided above of the embodiments illustrated in FIGS. 1-4 and 10 focuses on light beams, it should be apparent to one skilled in the art that alternative forms and wavelengths of energy, including ultrasound, radio frequency, and the like, may be substituted therefor without departing from the spirit or the scope of the invention. Still further, it should be apparent to one skilled in the art that although the triggers disclosed above do not require the performer to touch the trigger in order to activate it, tactile triggers may be substituted therefor without departing from the spirit or the scope of the invention. By way of example, without intending to limit the present invention, in the embodiment illustrated in FIG. 1, strings may be stretched between posts 10, with strain gauges substituted for light emitters 30 and/or light detectors 35. As the performer plucks, touches, or otherwise engages the string, the strain gauge may record the difference in pressure. When the difference in pressure is greater than a predefined threshold, the trigger associated with the string may be activated.

Figure 6:
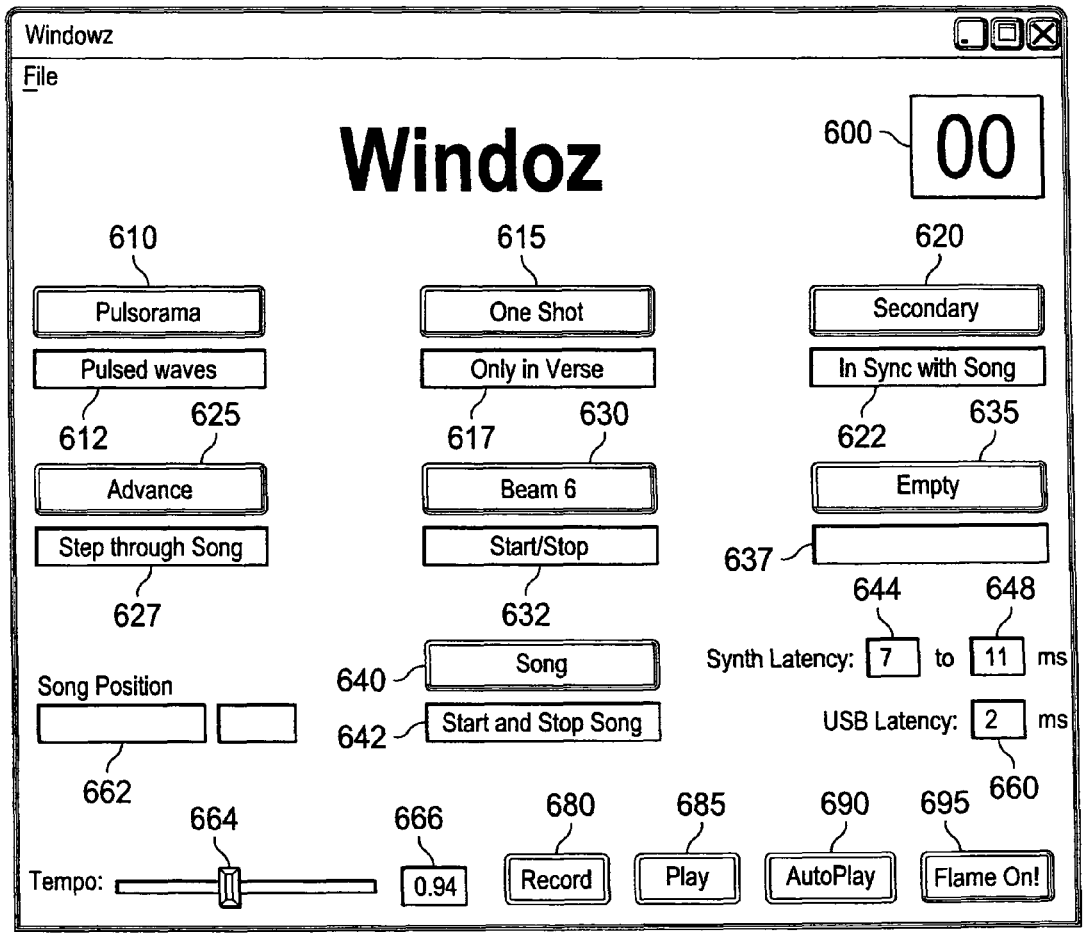
FIG. 6 is a screen capture of a computer based content presentation and content editing user interface.

FIG. 6 is a screen capture of a computer based content presentation and content editing user interface. In this embodiment, user interface elements 610, 615, 620, 625, 630, 635, and 640 represent individual triggers which can be activated by the performer. In one embodiment, the user interface elements are presented on a touch-screen or other such two-way user interface. In this embodiment, the trigger is activated when the performer touches the surface of the touch screen. This allows the performer to activate a plurality of triggers at the same time, just as with the physical interfaces described above in relation to FIGS. 1-4 and 10.

In an alternative embodiment, user interface elements 610, 615, 620, 625, 630, 635, and 640 may be presented via a traditional computer monitor or other such one-way user interface. In such an embodiment, and at the performer's preference, the performer can activate the trigger associated with a user interface element by simply positioning a cursor or other pointing device over the appropriate user interface element. Alternatively, the performer may be required take a positive step, such as clicking the button on a mouse or joystick, pressing a keyboard button, or the like, when the cursor is located over a given user interface element. The later alternative has the added benefit of limiting the likelihood that the performer will unintentionally activate a given user interface element.

For simplicity purposes, the description of the invention provided herein describes a user interface with seven triggers, or "beams". However, it should be apparent to one skilled in the art that the number of triggers can be readily increased without departing from the spirit or the scope of the invention. Furthermore, reference to a trigger as a "beam" should not be deemed as limiting the scope of the invention to only electromagnetic waves. It should be apparent to one skilled in the art that any trigger can be substituted therefor without departing from the spirit or the scope of the invention.

Figure 5:
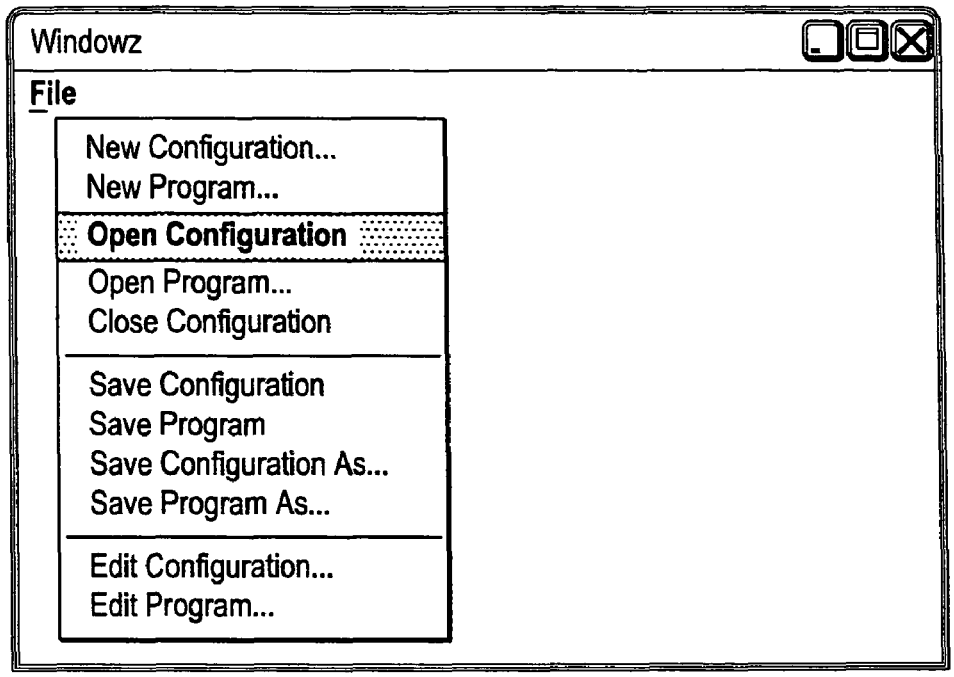
FIG. 5 is a sample user interface menu.

The user interface illustrated in FIG. 6 includes triggers 610, 615, 620, 625, 630, 635, and 640. The behavior of each trigger is preferably customizable by allowing the composer to change one or more control parameters. Such customization can occur via a user interface similar to that illustrated in FIG. 9, which can be selected via a user interface menu similar to that of FIG. 5, or by clicking on a trigger from FIG. 6 while the triggers are disabled (described below).

The control parameters control various aspects of the content or content segment presented when a given trigger is activated. By way of example, without intending to limit the present invention, an auditory-enabled embodiment, such aspects may include, but are not limited to, trigger type 902, synchronization ("sync") 904, mode 906, start resolution 908, pulse delay 978, pulse resolution 914, freewheel 912, step 918, step interval 920, polyphony 924, volume 926, and regions 930. It should be apparent to one skilled in the art that alternative aspects may be added or substituted for the aspects described above without departing from the spirit or the scope of the invention.

Trigger type 902 establishes the general behavior of a trigger. More specifically, this establishes how a trigger behaves each time the trigger is activated and/or deactivated. In a preferred embodiment, the trigger types include, but are not limited to:

Start/Stop: Start/Stop trigger mode starts or stops the Segment every time the trigger is activated. That is, the trigger is activated once to start the content presentation, and when the trigger is activated again, content presentation stops. If the trigger is activated a third time, the content presentation starts at the beginning of the content segment. However, if the trigger is slaved (described below) with a song currently performing, it preferably resumes at the current position within the song instead of playing from the top. If more than one content segment is associated with the trigger, it cycles through them, but always starts at the beginning of each content segment.

Start/Pause: Start/Pause trigger mode is almost the same as Start/Stop with one important difference. When the trigger is activated the third time, content presentation resumes where it left off when the trigger was activated the second time. Only when the end of a content segment is reached will the next content segment in the set be presented. However, like Start/Stop, when synchronized to a song, playback always resumes at the current position in the song.

Momentary/Stop: Momentary/Stop trigger mode is similar to Start/Stop except that it reacts to both activation and deactivation of the trigger. Activating the trigger will start content presentation. Releasing, unblocking, or otherwise deactivating the trigger will cause content presentation to cease.

Momentary/Pause: Like Momentary/Stop, the Momentary/Pause trigger mode builds on Start/Pause by responding to both trigger activation and deactivation to start and stop content presentation.

Pulsed: Pulsed trigger mode causes reactivation of the trigger. Once the trigger is activated, it cycles through presentation of new content segments at the rate defined by the Pulse menu (described below). To do so, it cycles through a defined list of content segments that are associated with the trigger. When the trigger is deactivated, the content segment(s) currently being presented will continue to be presented until finished, or when replaced by a subsequent pulsed content segment (see Polyphony below.)

One Shot: One Shot mode is similar to pulsed trigger mode in that it triggers a content segment to play. However, unlike pulsed trigger mode, only a single content segment is presented regardless of how long the trigger is activated.

Song Advance: This special trigger mode does not directly control content presentation. Instead, it increments the song to the next content section or set of content sections. The timing of the switch can be set by the start resolution, described below, so that the switch occurs on a musically pleasing boundary.

A region 930 is a set of one or more content segments that are presented when a corresponding song section is selected. A trigger can contain a set of regions 930, one for each section within the song. The trigger can also have a default region, which plays when there is no active song or if the trigger is ignoring the song (i.e. if synchronization set to none, as described below).

Each region 930 carries at least two pieces of information, the section with which it is to synchronize (illustrated in FIG. 9 by drop-down box 938), and a list of one or more content segments (illustrated by segments list 960) to be presented. There is preferably no limit to the number of content segments with which a region may be associated, and new content segments can be added or removed by clicking on buttons 962 and 964, respectively. Each region preferably presents the content segments according to a composer-defined order, cycling back to the top when end of the list is reached. In the embodiment illustrated in FIG. 9, the order can be changed by clicking on a content segment in list 960, and then clicking the Move Up 966 or Move Down 968 button, as appropriate. A content segment can appear in list 960 more than once, if so desired.

It should be noted that logically, sections and regions are not the same. Sections define the layout of a song (described below), whereas regions define what a trigger should present when the song has entered a specific section. To keep things easy, the matching of a region to a section can be accomplished by using the same name.

Figure 8:
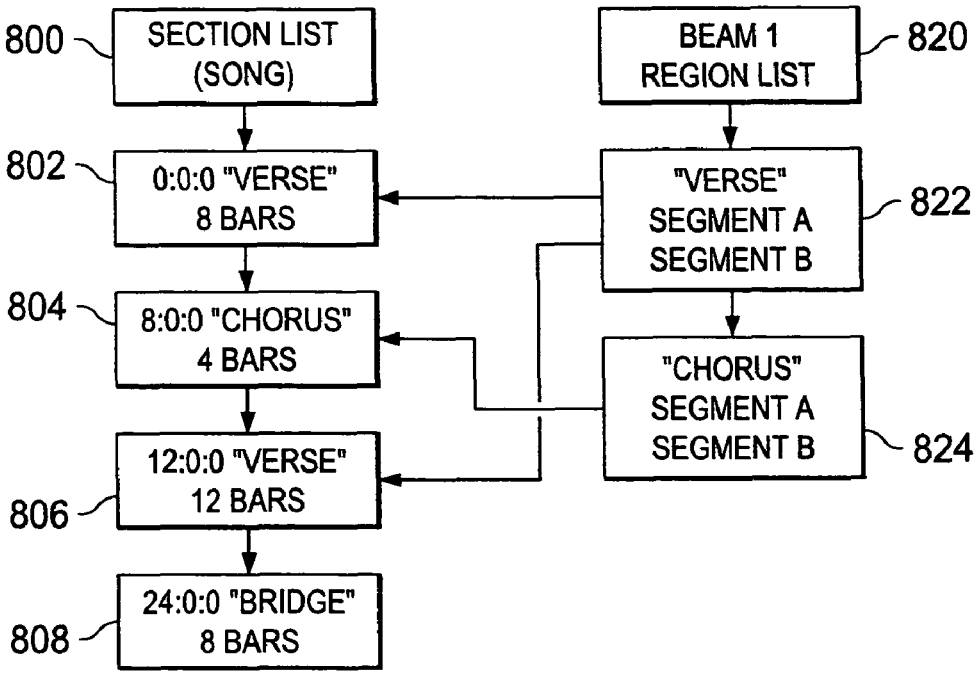
FIG. 8 is a block diagram illustrating the interrelationship between sections and regions.

FIG. 8 illustrates the relation of a program's song section list (Block 800) to a given trigger's region (Block 820). In FIG. 8, the song lays out a performance where the "Verse" section (Block 802) is presented for 8 intervals, the "Chorus" section (Block 804) is presented for 4 intervals, the "Verse" section (Block 806) is presented for 12 intervals, and the "Bridge" section (Block 808) is presented for 8 intervals. Meanwhile, the trigger is configured with just two regions, "Verse" and "Chorus". Region "Verse" has two content segments in it, Segment A and Segment B. Region "Chorus" includes two content segments, Segment A and Segment C. Note that a "Bridge" region is not defined. When the song enters the first "Verse", the content segments in the "Verse" region are presented. When the song then enters the "Chorus" section, the trigger switches to its "Chorus" region and presents the segments specified therein. Then, when the Song enters the second "Verse" section, the trigger switches back to the original "Verse" region and uses those Segments again. Finally, when the Song enters the "Bridge" section, the trigger stops presenting content because a matching Region is not defined.

Not shown are the region lists for other triggers. Each trigger carries its own mapping of regions to sections. By way of example, without intending to limit the present invention, another trigger might have regions defined for all three sections ("Verse", "Chorus", and "Bridge"), with different content in each, while still another trigger might have only a "Default" region, which provides content segments to be presented when the song is not actively running Synchronization 904 determines how a trigger relates to other triggers in the context of a song. A preferred embodiment of the present invention allows for three different synchronization types:

None: The trigger is not treated as part of a song, and plays on its own. Master: The trigger controls the playback of a song. If the trigger is in Play/Stop or Play/Pause mode, it starts and stops the song performance. If the trigger is in Song Advance mode, it moves the song to the next section or program with each activation of the trigger.

Slave: The trigger synchronizes content presentation with a song performance. This causes the trigger to always pick segments from a region that correspond with the currently active section in the song. If the trigger is operating in one of the Play or Momentary modes, this also forces the trigger to synchronize its playback with the current position in the section.

Mode 906 allows the trigger to define a content segment as being in one of three modes:

Primary: The primary segment defines the underlying music. In a preferred embodiment, only one content segment at a time can be presented as the primary content segment. If two or more triggers are configured such that the content segments associated therewith are the primary segments, then as one trigger is activated, its content segment immediately replaces the previous primary segment. The primary segment usually provides the underlying musical parameters, including time signature, key, and tempo. Generally, for most songs, one or two triggers will be configured such that their content segments are primary segments. Most other triggers are configured such that their content segments are secondary segments. In song mode, the master trigger should be configured in primary mode while all slave triggers are configured in secondary mode.

Secondary: Secondary content segments play without replacing other Segments. That is, more than one secondary content segment can be presented at a time.

Controlling: Controlling content segments override control information that the primary segment normally provides. This is useful to introduce changes in tempo, groove level, and even underlying chord and key. These can be layered as well.

Start Resolution 908 determines the timing at which the content segment should start or stop when the trigger is first activated. When a trigger is operating in pulsed mode, the first content segment associated therewith is presented after the trigger is first activated, based on the start resolution. Then there is a delay, as programmed in pulse delay 978, after which an additional content segment is presented. Such a configuration greatly reduces the likelihood of unintended double trigger activation.

Pulse resolution 914 selects the interval between subsequent content segment presentations when the trigger operating in pulsed mode. Because pulse resolution 914 is different from start resolution 908, it allows start resolution 908 to be very short so the first content segment can be quickly presented, then after the pulse delay 978 period, subsequent content segments are presented based on the timing defined in pulse resolution 914.

When a pulse is first triggered, it usually will be configured to begin content presentation as soon as possible, to give the user a sense of instant feedback. However, subsequent pulses might need to align with a broader resolution for the pulsed content to be properly presented. Thus, two timing resolutions are provided. The start resolution, which is typically a very short interval, or 0 for immediate response, which sets the timing for the first content segment. In other words, the time stamp from activating the trigger is quantized to the start interval, and the resulting time value is used to set the start of the first note. However, subsequent notes are synchronized to the regular pulse interval. In this way, an instant response is provided that slaves to the underlying rhythm or other aspect of the content.

Freewheel 912 forces subsequent pulses to stay locked to the timing of the first pulse, yet be played at the interval determined by pulse resolution 914. By default, the pulse interval locks to the time signature, as set by the start of the content segment. However, there may be instances when it should lock to the start of the pulse. The Freewheel option forces the subsequent pulses to stay locked to the timing of the first pulse, yet be presented at the interval determined by the pulse resolution.

There are preferably at least two ways to configure the system such that multiple content segments will play within a region. The simplest is to create the content segments as separate files and list them within the region definition. An alternative is to divide a content segment into pieces, with each piece presented separately while incrementing through the content segment. This later alternative is implemented using step option 918. For trigger modes that rely extensively on performing multiple content segments in quick succession, stepping is an efficient alternative to creating a separate file for each content segment. To prepare for stepping, the composer or content segment creator uses DirectMusic Producer, distributed by Microsoft Corporation of Redmond, Wash., or another such computer software application, to put markers in a content segment. When these markers exist in a content segment, activating step option 918 effectively causes the trigger to treat each snippet between markers as a separate content segment.

As an alternative to entering markers in content segments, a composer can simply activate step mode 918, and then define a step interval 920. When a step interval 920 is defined, the trigger will automatically break the content segment into pieces, all of the same size. In the embodiment illustrated in FIG. 9, step interval 920 defines time interval to be used, and multiplier 922 allows the actual interval to be otherwise extended. By way of example, without intending to limit the present invention, if step interval 920 was set to 1, and multiplier 922 was set to 2, the interval would be 2 bars. If a content segment already has markers within it, step interval 920 is preferably ignored.

If the trigger mode is set to pulsed or one shot, more than one instance of a content segment can be simultaneously presented, if so desired. Polyphony 924 determines the number of instances allowed. For example, with a polyphony setting of 1, each content segment start automatically cuts off the previous content segment. Alternatively, with a polyphony setting of 4, four content segments will be presented and allowed to overlap. If a fifth content segment is presented, it will cause the first content segment to be cut off. If the composer configures both controlling segments and polyphony of greater than 1, the results may be unpredictable when because several content segments may compete to control the same parameters.

A master content presentation intensity slider 926 preferably controls the overall intensity level of the content presented in association with the trigger. Alternatively, a composer can enter the intensity in numeric form using text box 928.

In addition to the trigger-specific settings described above, a set of attributes is also associated with each content segment in list 960. In an auditory-enabled embodiment, this set of attributes preferably includes, but is not limited to:

Intensity 942—Each content segment can have its own intensity level, in addition to the intensity setting associated with the trigger.

Transpose 946—This attribute allows the composer to shift the pitch, brightness, scent, or other characteristic of the content segment up or down. In an auditory-enabled embodiment, transpose 946 may allow a pitch shift of up to two octaves.

Play start 950 and play end 952—The content segment can be configured such that it is presented beginning from a specific point within the content segment, and ending at another point. This allows the same content segment to be used in different places by selecting different areas within the content segment.

Loop start 954, loop end 956, and repeat 958—These attributes allow a composer to specify that all or a portion of the content segment is to be repeatedly presented. If a loop start 954 is entered, each time the loop is repeated, the loop begins at the time specified therein. If a loop end 956 is specified, the loop jumps to the loop start 956 after the time specified in loop end 956. Repeat 958 specifies the number of times the loop is to be repeated.

Figure 9:
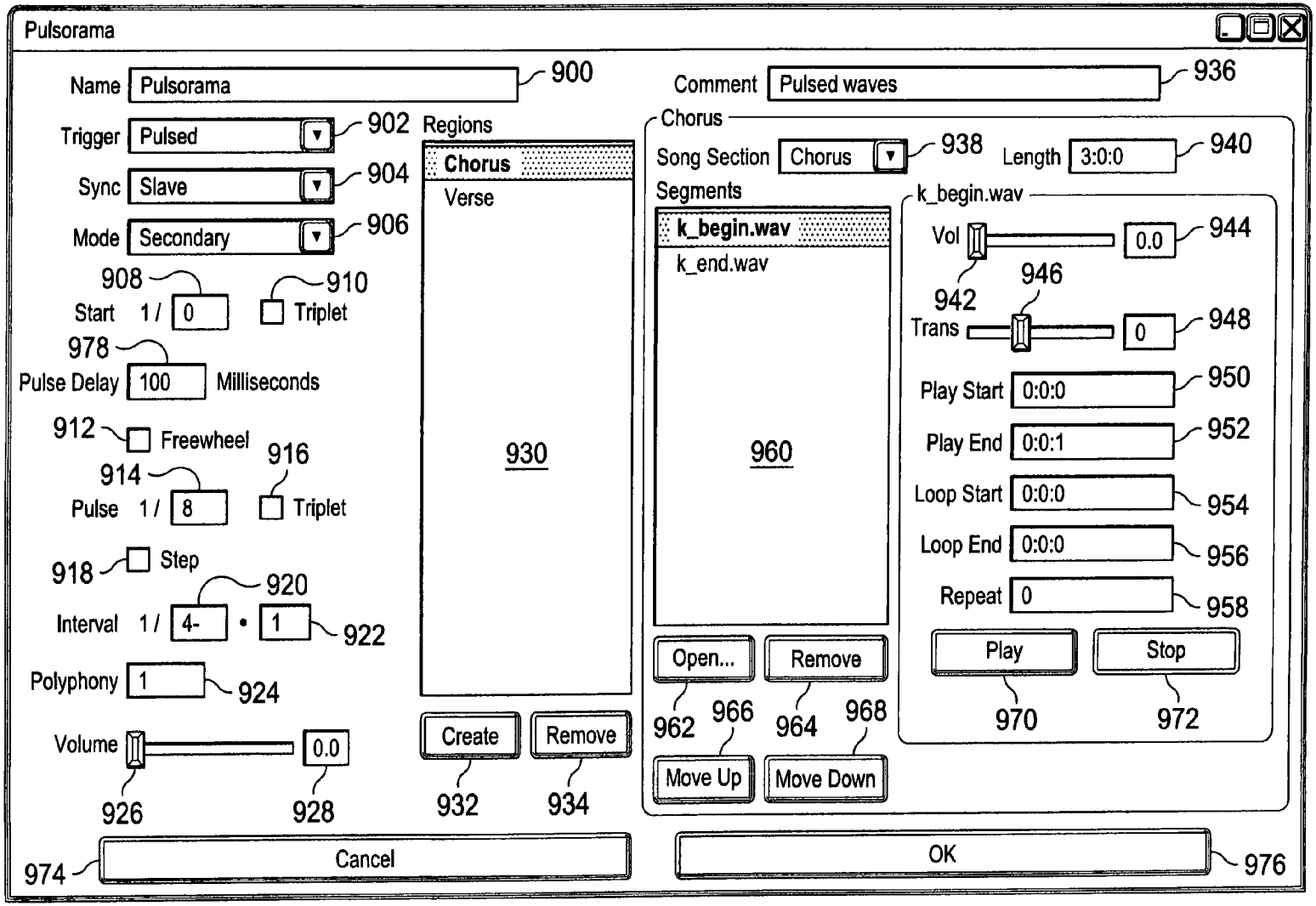
FIG. 9 is a screen capture of a sample trigger control parameter customization user interface.

By pressing the play button 970, the composer can cause the system to present the content segment using to the attributes specified in FIG. 9.

The composer can save the trigger configuration by giving the set of settings a unique name 900 and clicking OK 976. The composer can also add a comment 936 to further describe the functionality associated with that particular trigger configuration. Should the composer wish to start over, the composer can click cancel 974, and any unsaved changes will be deleted.

The system preferably allows the composer to group individual trigger configurations into programs, with each program including the triggers to which the individual trigger configurations have been assigned. A program is simply a set of programs that are bundled together so a performer can quickly switch between them. It should be noted that, for added flexibility, a plurality of system-level configurations can share the same programs.

Although each trigger within a program is free to perform independently, the present invention allows the triggers to work together. To accomplish this, a composer preferably builds content segments that play well together. However, such content segment combinations, on their own, can get boring pretty quickly. It helps to have the content evolve over time, perhaps in intensity, key, orchestration, or the like. This can be accomplished by authoring multiple trigger/content segment configurations and swapping in a new set of these for one or more triggers at appropriate points in the performance. The song mechanism provides such a solution. A song is a series of sections, typically with names like "Verse" and "Chorus". Each section may contain nothing more than a name and duration, but they provide the minimum required to map the layout of the song. The program can walk through the song sections in sequential order, either by waiting for a time duration associated with each section to expire, or by switching to the next section under the direct control of one of the triggers (e.g., using the Song Advance trigger mode described above). The program defines the song, including the list of sections. In turn, as described above, each trigger can have one or more regions associated therewith.

Figure 7:
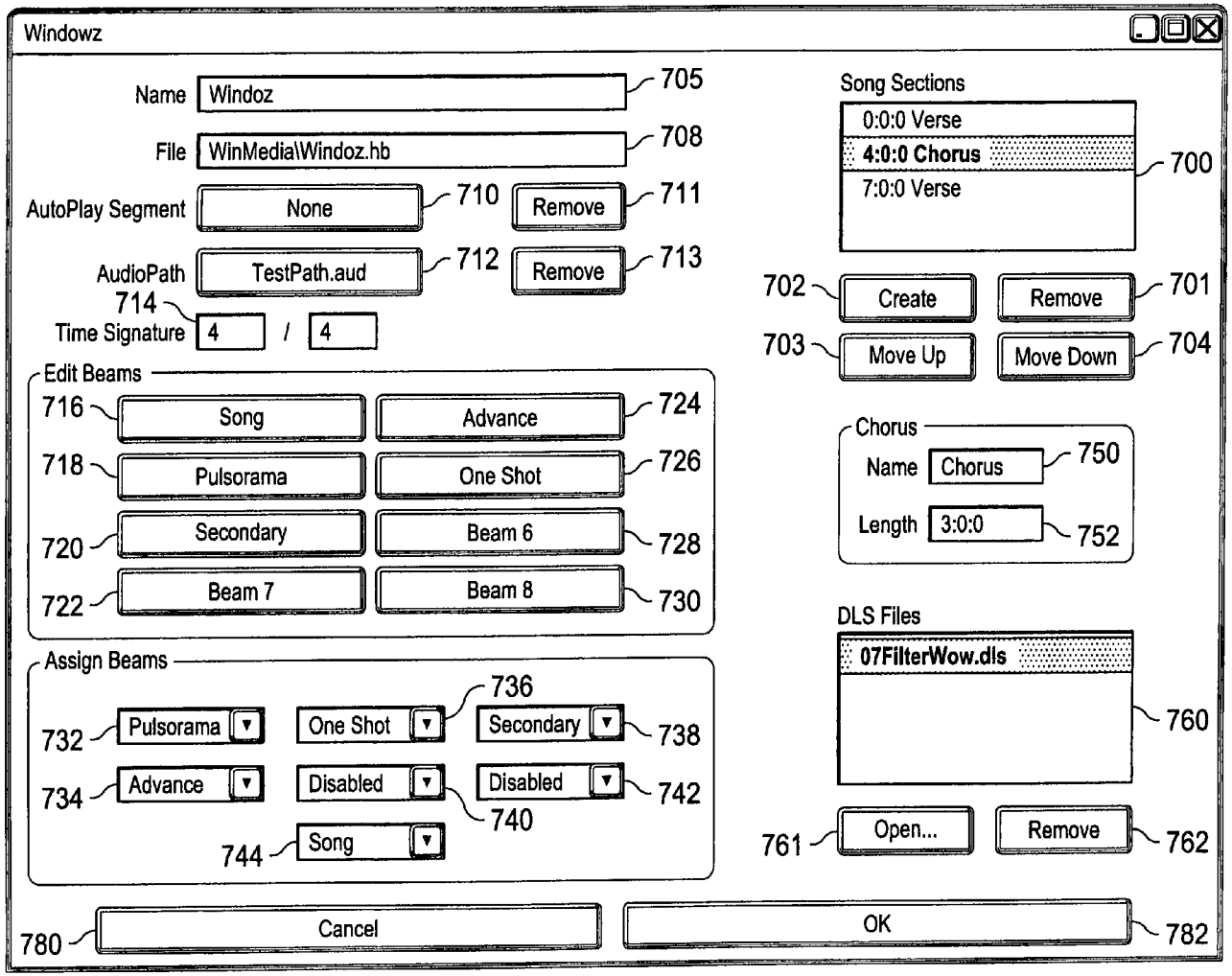
FIG. 7 is a screen capture of a sample program creation user interface.

FIG. 7 is a screen capture of a sample program creation user interface. As illustrated in FIG. 7, each program is preferably given a unique name (field 705). The location at which the program is stored may also be presented for reference (field 708). The user interface preferably lists the song sections defined within the program (list 700), and allows the composer to create (button 702), remove (button 701), and revise the order of such song sections (buttons 703 and 704). The program creation user interface also allows the composer to associate trigger configurations with the program (buttons 716, 718, 720, 722, 724, 726, 728, and 730), and to assign the trigger configurations to specific triggers (drop-down boxes 732, 734, 736, 738, 740, 742, and 744).

In an auditory-enabled embodiment, content segments authored in DirectMusic Producer, and traditional MIDI files that use the General MIDI sound set, can automatically link and load the Downloadable Sound ("DLS") instruments they use. However, traditional MIDI files that do not use the General MIDI sound set cannot readily access the necessary support files. It is therefore preferable to allow the composer to specify, by clicking Open button 761, one or more DLS files to be loaded in conjunction with the program. The DLS files associated with the program are preferably listed in DLS file list 760 or a similar interface.

In addition, the user interface illustrated in FIG. 7 allows a composer to specify an AutoPlay content segment. When a program first activates (such as when switching between programs), it is often desirable present a content segment that initializes the performance. By way of example, without intending to limit the present invention, in an auditory-enabled embodiment, the content segment may set up instruments, set the tempo, or set the time signature such that subsequently presented content segments will be properly presented, regardless of which trigger is activated first. The program carries one special content segment, called the AutoPlay Segment, which it runs immediately upon activation, and this content segment can be selected using button 710. If an AutoPlay Segment is accidentally defined, clicking remove button 711 will remove that setting from the program.

In an auditory-enabled embodiment, a program can also have an AudioPath associated therewith. An AudioPath preferably defines one or more effects filters to be loaded and run against the content segments as they are triggered. The user interface illustrated in FIG. 7 allows the composer to specify the AudioPath using button 712, and to remove the AudioPath using button 713.

Time signature section 714 of the user interface allows the composer to set a default time signature for the program. The time signature can be used when arranging song sections, editing content segment playback points, or displaying the current song position as the content is being presented.

Figure 11:
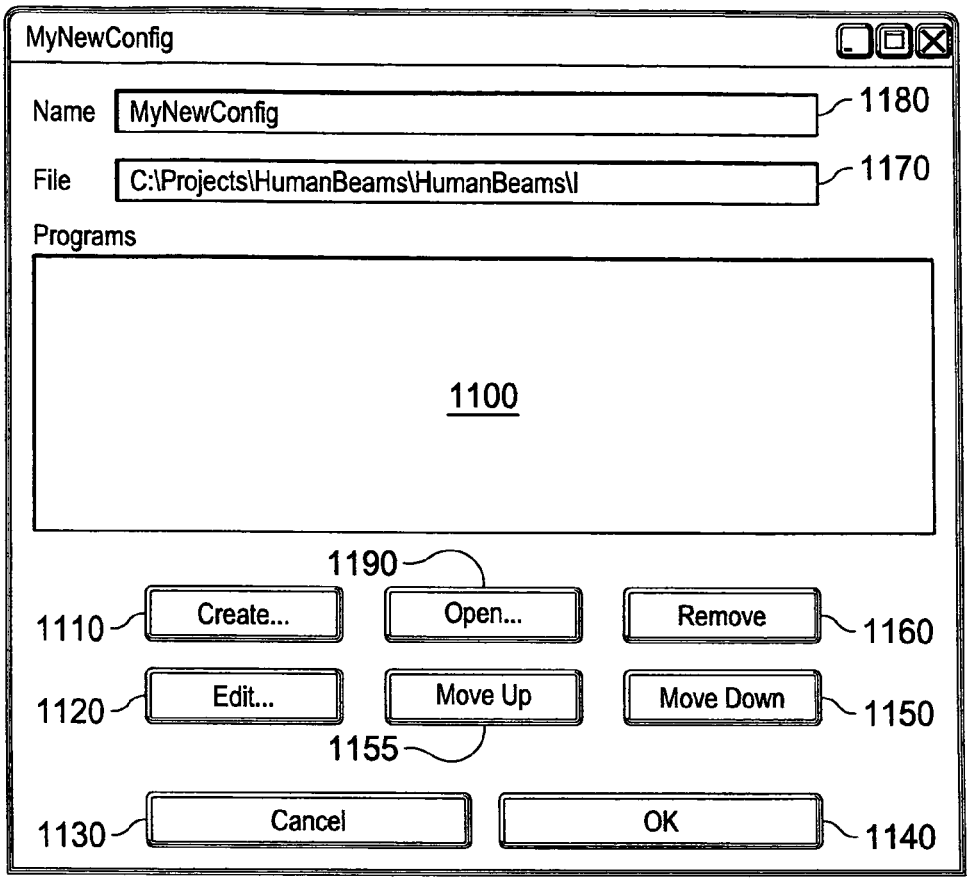
FIG. 11 is a screen capture of a sample system-level configuration file creation user interface.

The present invention also preferably allows composers and/or performers to group programs together to create a system-level configuration file. Such system-level configuration files can be created using a user interface similar to that illustrated in FIG. 11. Such a user interface preferably lists all programs contained in the system-level configuration file (list 1100), provides options for naming the system-level configuration (field 1180), and allows the composer to easily create new programs (button 1110), add previously crated programs (button 1190), edit a previously created program (button 1120), remove a program (button 1160), and organize the list of programs (buttons 1150 and 1155). The program list preferably displays all of the programs that belong to the system-level configuration. Each program can have a name, numeric ID based on its position in the program list, and other attributes associated therewith. The name, numeric ID, and/or other attributes may be transmitted to the user interface as a performance is occurring, thus providing the performer with information about the program being performed. By way of example, in the embodiment illustrated in FIGS. 2-4, the numeric ID can be displayed on display 220.

In FIG. 6, a system-level configuration named "Windoz" has been loaded. In this configuration, the Pulsorama trigger configuration illustrated in FIG. 9 has been assigned to the first trigger, trigger 610. The comment associated with that trigger configuration appears below the trigger, in block 612. Additional trigger configurations have been assigned to triggers 615, 620, 625, 630, and 640. No trigger configuration has been assigned to trigger 635, as is indicated by the "empty" text therein. The system also preferably displays the current program name and/or number (block 600), for easy reference by the performer.

When the performer enables the triggers by clicking button 695, the user interface illustrated in FIG. 6 can be used by the performer to present content to an audience. The performer can trigger the presentation of the AutoPlay content segment associated with the current program by clicking AutoPlay button 690, and can trigger the presentation of a previously recorded presentation using Play button 685. The performer can record his or her performance by clicking button 680, adjust the tempo of the performance by adjusting slider 664 or entering a numerical value in text box 666. Additional information useful to the performer, including the song position 662 and various latency measurements (644, 648, and 660) may also be provided.

Figure 12:
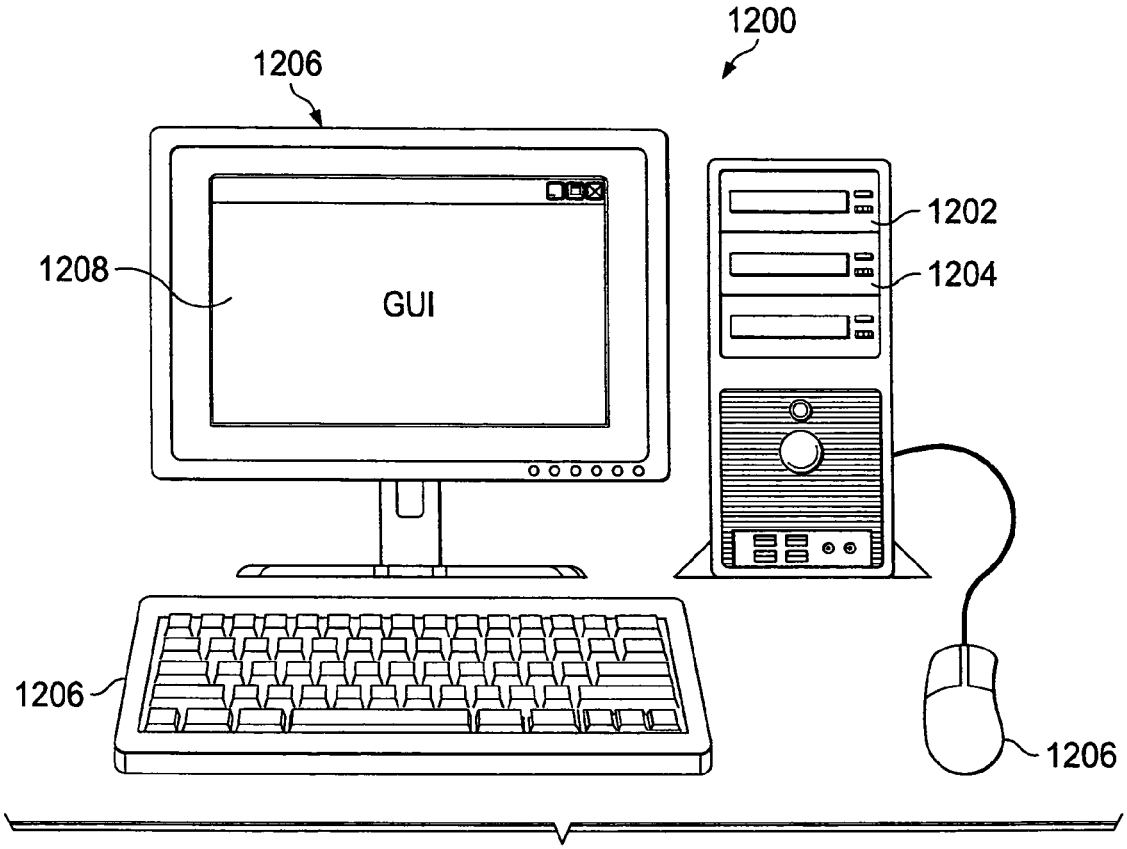
FIG. 12 is drawing of a computer configured to run Beamz Studio.

However, some embodiments recognize that the portable, table-top content presentation user interface may be too cumbersome to be considered a truly portable musical composition instrument. Musicians, DJs, and the like may prefer to only have to carry a laptop computer, from which they can compose interactive music. In addition, some users may not possess the requisite motor skills required to operate the portable, table-top content presentation user interface but may be capable of operating a computer. Furthermore, some users may prefer a more economical device fully contained in a computer. Accordingly, teachings of certain embodiments recognize the need to be able compose and perform music on a computer using a graphical user interface ("GUI") tied to user-controlled peripheral input devices. FIG. 12 shows one embodiment that may provide a solution to these and other problems.

In one embodiment, a MIDI keyboard may be connected to a MIDI input port on a computer wherein the musical sounds can be mapped to be triggered by selected keys on the keyboard. The composer may map notes to specific beams that may then be triggered by the selected keys.

In another embodiment, a computer mouse may be connected to an input port on a computer wherein the musical sounds can be mapped to be triggered by clicks with the computer mouse. The composer may map notes to specific beams that may then be triggered by the computer mouse by clicking the beam on the GUI.

In another embodiment, a touch-screen computer monitor may be connected to an input port on a computer wherein the musical sounds can be mapped to be triggered by touches on the computer screen. The composer may map notes to specific beams that may then be triggered by the touch-screen monitor by touching the beam on the GUI.

In a second embodiment, the Beamz Music System is an interactive music player that allows a performer to play songs that were composed to be played interactively. Beamz Studio is a software tool that can be used to compose interactive music. Beamz Studio allows a user to add his own sound files in MIDI or .wav file format to a Beamz song, or to make a completely new song based on the user's own sounds.

Interactive music was not possible until recently when computers gained the ability to produce it. Up until then, all other forms of music were traditional. Before software-based interactive musical instruments became possible, music composition typically occurred in a linear form, where songs are played from start to finish as a pre-determined sequence of notes. Each note is written by the composer to play at a specific time and place within the composition—always. The tempo/key/chord of the song provides the composer with absolute control over how the song will sound when it is played in real-time—moment by moment.

In a way, traditional music composition can be described as pre-composed script (pre programming) that will be performed in real time by the pre-determined instruments, each playing pre-composed parts. The underlying theory of traditional music composition is the elimination of randomness as a way to avoid producing musical sounds that are unsympathetic to the ear. If each instrument played notes randomly, it would sound terrible, so traditional music strictly controls when each note will play. All notes are composed to play at a precise moment during the performance, and they must agree musically with all other notes that will be played by other instruments at that moment.

Whereas traditional music compositions consist only of pre-composed notes that will be played, interactive music compositions consist of a pre-composed selection of notes that could possibly be played at any moment during the performance. Like traditional songs, interactive songs must be composed in advance and the musical parts must all agree in musical terms (key, chords, etc.). Composing interactive music can be challenging at first, even for someone experienced at electronically producing traditional music.

Traditional musical songs are mapped out or arranged by sections. A basic song arrangement could be: 1-Intro, 2-Verse, 3-Chorus, 4-Break, 5-Verse, 6-Chorus, and 7-Ending. Each section of the song is played for a specific length (bars of music), then the song moves on to the next section. Since the chords & rhythms (music parts) often change from section to section, each one has its own related instrumental parts.

As illustrated in FIG. 12, Beamz Studio is configured to include a computer 1200 comprising a processor 1202, memory 1204, peripheral inputs 1206, and a graphical user interface ("GUI") 1208. In one embodiment, computer 1200 can be either a local or remote computer. In one embodiment, peripheral inputs 1206 can include, but are not limited to, a keyboard, a mouse, and a touch-screen monitor.

Figure 13:
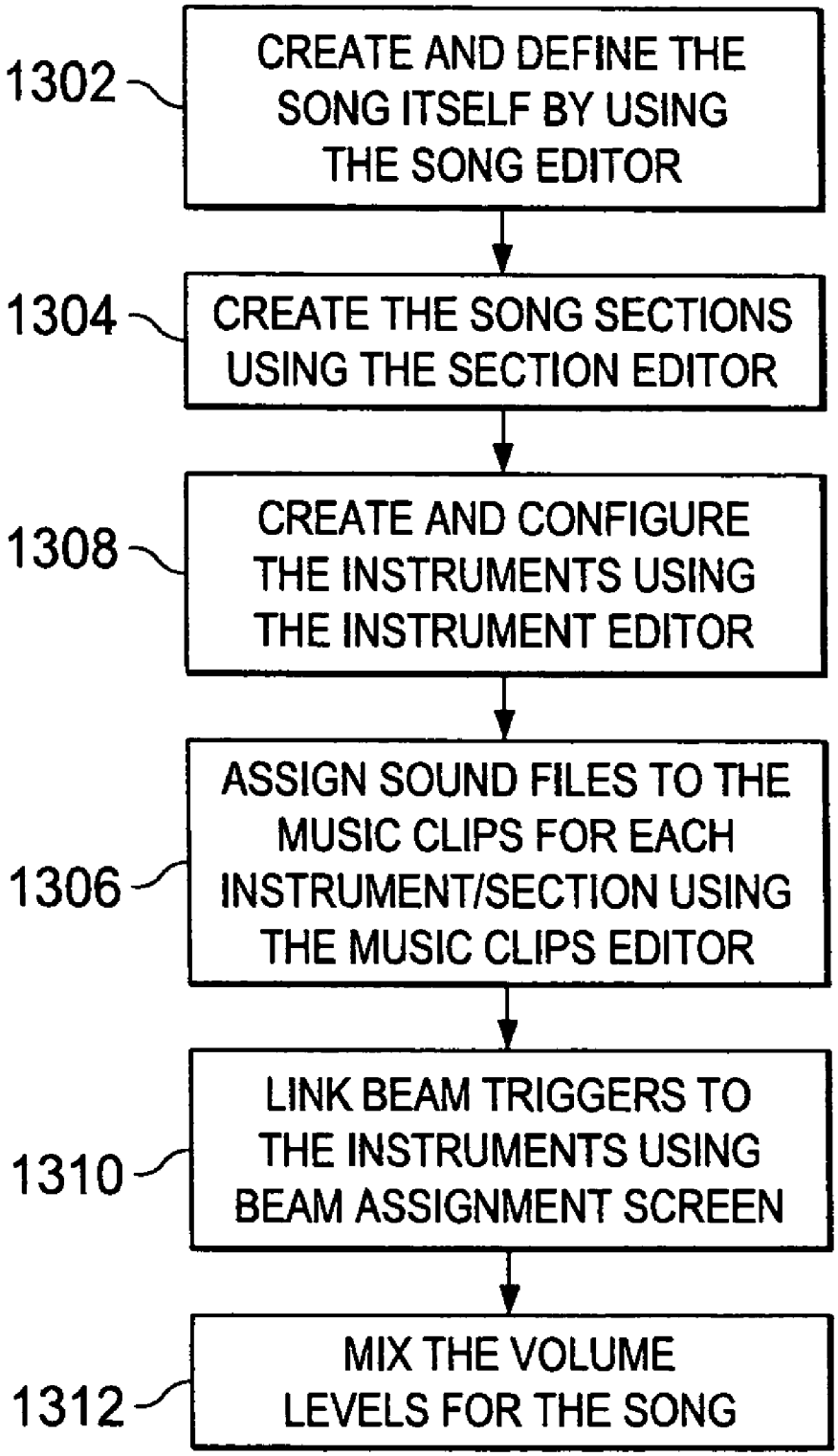
FIG. 13 is a block diagram of how to build a new song using Beamz Studio.

According to the flow chart as illustrated in FIG. 13, building a new song in Beamz Studio follows these basic steps using processor 1202, memory 1204, and GUI 1208: first, at step 1302, the user may create and define the Song itself by using the Song editor; second, at step 1304, the user may create the song Sections using the Section editor; third, at step 1306, the user may create and configure the Instruments using the Instruments editor;

fourth, at step 1308, the user may assign sound files to the Music Clips for each Instrument/Section using the Music Clips editor; fifth, at step 1310, the user may link Beam Triggers to the Instruments using the Beam Assignment screen; and sixth, at step 1312, the user may mix all the volume levels for the song.

When the Beamz System is installed, a master songs folder is created in memory 1204. Within this folder, every Beamz song has its own individual folder which is used to store the song's configuration files and all the sound files that are used by the song. When a new song is created, a new folder is created for the song inside of the Beamz music folder. Standard Beamz files needed by all Beamz songs are also copied into it at this time. It is important to know that in order for a sound file (or video) to be used by a Beamz Song, it must reside in the song's folder before it can be imported into the song. If the same sound file or video is used by several different songs, each song must have its own personal copy of it within its own song folder.

Adding a new sound file in the music clips editor first offers a list of the files that are already in the song's folder. Selecting one from this list will immediately include it in the music clip's list. If the desired sound file is not in the song folder, the user can navigate to it and select it where it resides. However, when the user selects one outside of the song folder, a copy of it is placed into the song folder and it is included in the music clip's list. The same thing applies when a video file is used by a song—a copy is made in the song folder.

As an aid to composers, Beamz Studio displays current song position information beneath the song's name on GUI 1208. The songs that came with the Beamz system are called Preset songs, and they cannot be directly edited. A User copy of a Preset song is automatically created when the Song Editor is opened for one of them. All copies of a song are always placed in the same song folder as the original song.

Illustrated in Step 1302, in order to make a new song, the user will Open the Tools menu on GUI 1208 and click on Create New Song. A new song will be created and the Song Editor will open for it. There are two ways to begin editing a current song: first, the user may click on the name of the song in Player's main view; click on any Beam in Player's main view—this enters song edit with the assigned Instrument selected; or second, open the Tools menu and click on Edit Song—only available for User songs.

In order to make a copy of the current song and edit the copy, the user will Open the Tools menu on GUI 1208 and click on Copy Song and Edit. This will make a copy of the current song to memory 1204 regardless of whether is a Preset or a User song. This is the only way to make a copy of a User song. In order to delete a user song, the user will Open the Tools menu and click on Delete Current Song. This option is not available for preset songs.

The sample song illustrated in FIG. 14 is 39 bars long, has 7 sections. Each section of the song has its own music part that will be played. When it is played, this song starts with the Intro then plays all sections thru the Ending, then stops. When more than one instrument plays a song, the music parts are shared by all of the instruments that play during each section of the song, and each instrument has its own part. See FIG. 15 for sample song with more than one instrument.

The individual instrument parts that are played for each section of a song are called Music Clips. Music Clip is the term for the pool of notes that each instrument will play during one section of the song. All Music Clips for an instrument constitute the part it will play during the entire song.

In traditional music, this means the notes that will be played and when they will be played during the song. Every note to be played by each instrument has to be composed in advance to be played at a specific point in time during the performance. Whenever the song is performed, it is always played the same way.

In Beamz Studio, music clip means the notes that are available to be played during the current section of the song. When the notes are actually played is determined by the musician who triggers a Beamz Instrument to play its active music clip. Music clips are part of a Beamz Instrument's definition, and how they actually play their sounds is determined by way the Instrument has been defined.

Figure 16:
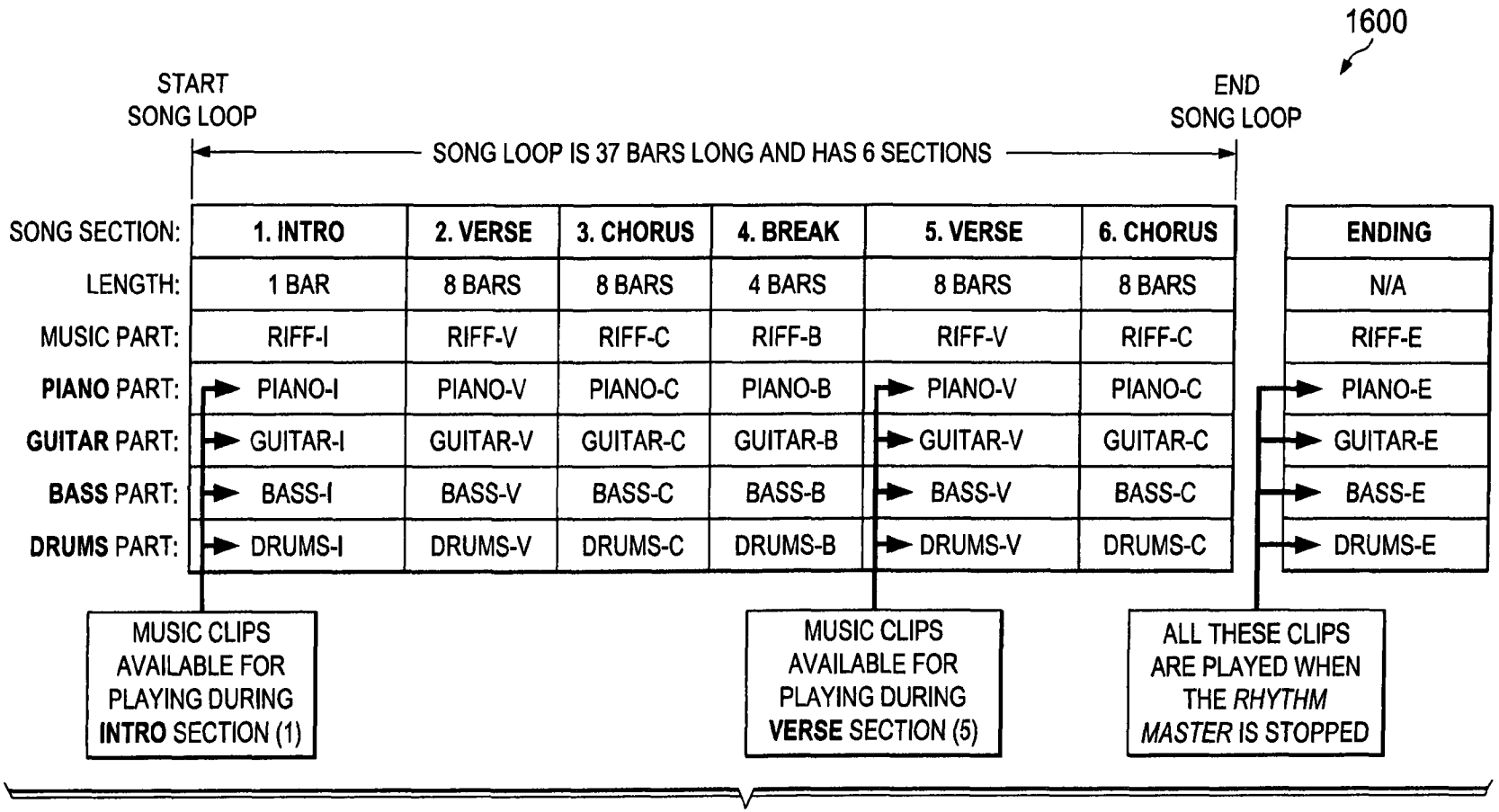
FIG. 16 is an example of a Beamz sample song with instruments added.

A Beamz song is played by starting and stopping the Rhythm instrument. When a Beamz song is played, it plays all sections of the song from the first thru the last section. Instead of stopping, a Beamz song will continue by playing all of the song sections again. It will continue to repeat the song until the performer decides it is time to stop the song. When a Beamz song is stopped, it will then play the Ending. FIG. 16 is an illustration of how the sample song would look as a Beamz song.

A Rhythm Master is a special looped part that supplies the "built-in" background music for a song from memory 1204. A typical example would be a combination of Bass and Drum parts. The Rhythm Master controls the playing of a Beamz song. Beamz songs will start to play when the Rhythm Master is started and stop playing when it is stopped. While the Rhythm Master is playing, the song continues to loop thru its sections until it is stopped by the performer. As the song progresses from one section to another, different music clips become available for each instrument—should the performer choose to play them by triggering a Beam Trigger that has been assigned to the instrument.

The Rhythm Master has a special property that makes it the Master controller for the song. It not only starts and stops the song, but it also serves as the master metronome for the song as well. As the Rhythm Master plays thru each song section, it becomes the official Active section in the song's progress—controlling which music clips are available on the other Instruments that are Slaved to it. When a Rhythm Master is stopped, all of the Ending music clips play, and the song stops.

When a Beamz song is first loaded from memory 1204 and the Rhythm Master has not yet been started, the Beamz will still play notes for each instrument, even though the song hasn't been started. All Beamz songs have a special section that is called the Free Running section. The Free Running section is just what its name implies: a free running set of music clips available for each instrument whenever the song is not under the control of a running Rhythm Master. The Free Running section is active when a song is loaded and remains active indefinitely until the Rhythm Master is started and takes control of the song. Once the Master is stopped the Free Running section becomes active again.

The Free Running section is actually a pseudo section that is a part of every Beamz song.

It is intended to play indefinitely when it is active, and has no specified length. Volume is the only property that may be edited for the Free Running section. It is active whenever there isn't a Rhythm Master playing. It provides default Music Clips for each Instrument that can be played without the Rhythm background. No other song section may be named Free Running.

When a Rhythm Master is stopped, an ending automatically plays. The Ending section is another pseudo section that is a part of every Beamz song. It contains the music clips that will be played when the song ends. No other song section may be named Ending. When a Rhythm Master is stopped, the Free Running section becomes active and ALL the music clips in the Ending section are automatically triggered to play without any input from the performer. See FIG. 17 for an illustrative embodiment.

In Beamz terminology, the lasers on the consoles are called Beams and they work as triggers—where breaking a beam of light turns a Trigger on. The trigger stays on as long as the light beam remains broken. Pressing (and holding) the two large buttons on the console has the same effect as breaking the light beam, so they are considered to be Beam Triggers as well. In other embodiments, the Beam Triggers may be configured to be triggered through software manipulation using peripheral inputs 1206. The Beamz System supports 2 Beamz units, so there are a total of 16 possible Beam Triggers that can be assigned to Beamz instruments. More than one Instrument can be assigned to a single Beam enabling them all to be triggered at once by the same Beam Trigger, so there are often more than 16 instruments in a song.

All Beamz songs have their own collections of Beamz Instruments. Beamz Instruments are setup as part of a song, and the Music Clips they play during the song are setup as part of the Instrument. A Beamz Instrument must be assigned to a Beam Trigger so it can be triggered by the performer. How an Instrument responds to a Beam Trigger is determined by which Trigger Type it uses.

In essence, a Beamz Instrument is an interactive sound file player. When an Instrument is triggered by its assigned beam, it plays a sound file from its active music clip. The Instrument plays an existing sound file that is assigned to its active music clip. The kinds of sound files in a music clip can vary, so the way an Instrument plays them can vary as well. For example, a sound could be played as a single note, or multiple notes that will be streamed, or a complete musical phrase that will be repeated (looped). How each sound will be played is determined by the Trigger Type that has been selected for the Instrument.

Each Beamz instrument has a Music Clip for every section of the song, including Free Running & Ending. When a new instrument is created, an empty Music Clip is created for each song section. If a new section is added to a song, empty music clips for it will be added to all instruments in the song. When a song section is removed, all of its associated Music Clips are also removed.

A Music Clip is a pool of sound files that the instrument may play during the current song section. More specifically, it is a list of sound files in the song folder that will be played each time an instrument plays one. The list is numbered from top to bottom and each sound file is played in the order indicated by its number. If there is only one file on the list, it will be played each time the instrument plays a sound. When there are many sound files on the list, it steps thru them when it needs something to play—each time playing the next one on the list. Then the list is repeated. If the instrument is to be silent during a certain section, this list will be empty, and the Music Clip will produce no sound if the instrument is triggered.

Figure 18:
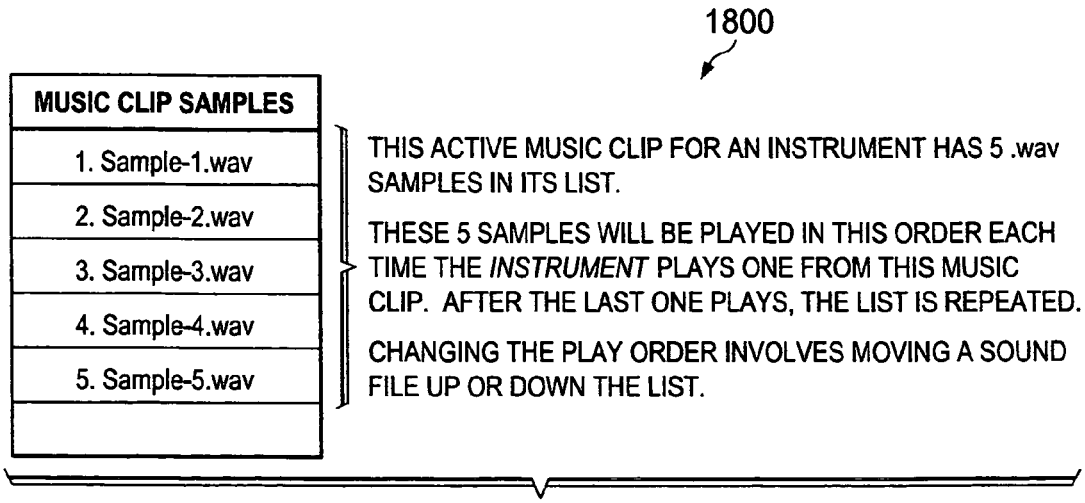
FIG. 18 is a screen capture of Music Clip Samples.

There is a close relationship between the types of sound files and the Trigger Type that will be used to play them back. FIG. 18 shows one embodiment of Music Clip sample .wav files as represented on GUI.

The various trigger types are now described in detail:

One Shot: Each time the Beam is triggered, it steps thru the list and plays one sound file from beginning to end.

Pulsed: Each time the Beam is triggered, it plays the next sound file on the list from beginning to end. If the Beam trigger is held on, it will cycle thru the list playing each sound file in succession. The Sounds are streamed at a rate that corresponds to musical notes which is specified as a Pulse Rate.

Start/Stop: When triggered, it will loop a single sound file on the list repeatedly until it is stopped by another trigger. Each time it starts, it plays the loop from the beginning.

Start/Pause: This works the same way as Start/Stop except when stopped, it stops in place (paused). The next time it starts, it will loop from the place where it was last stopped.

Momentary/Stop: This works the same way as Start/Stop except it loops only while the Beam Trigger is held on.

Momentary/Pause: This works the same way as Start/Pause except it loops only while the Beam Trigger is held on.

Song Advance: Each time the Beam is triggered, it advances the song to the next Section.

Swap Beams: Swaps the Beamz controller and the screen display to the alternate set of Beam Triggers.

Figure 19:
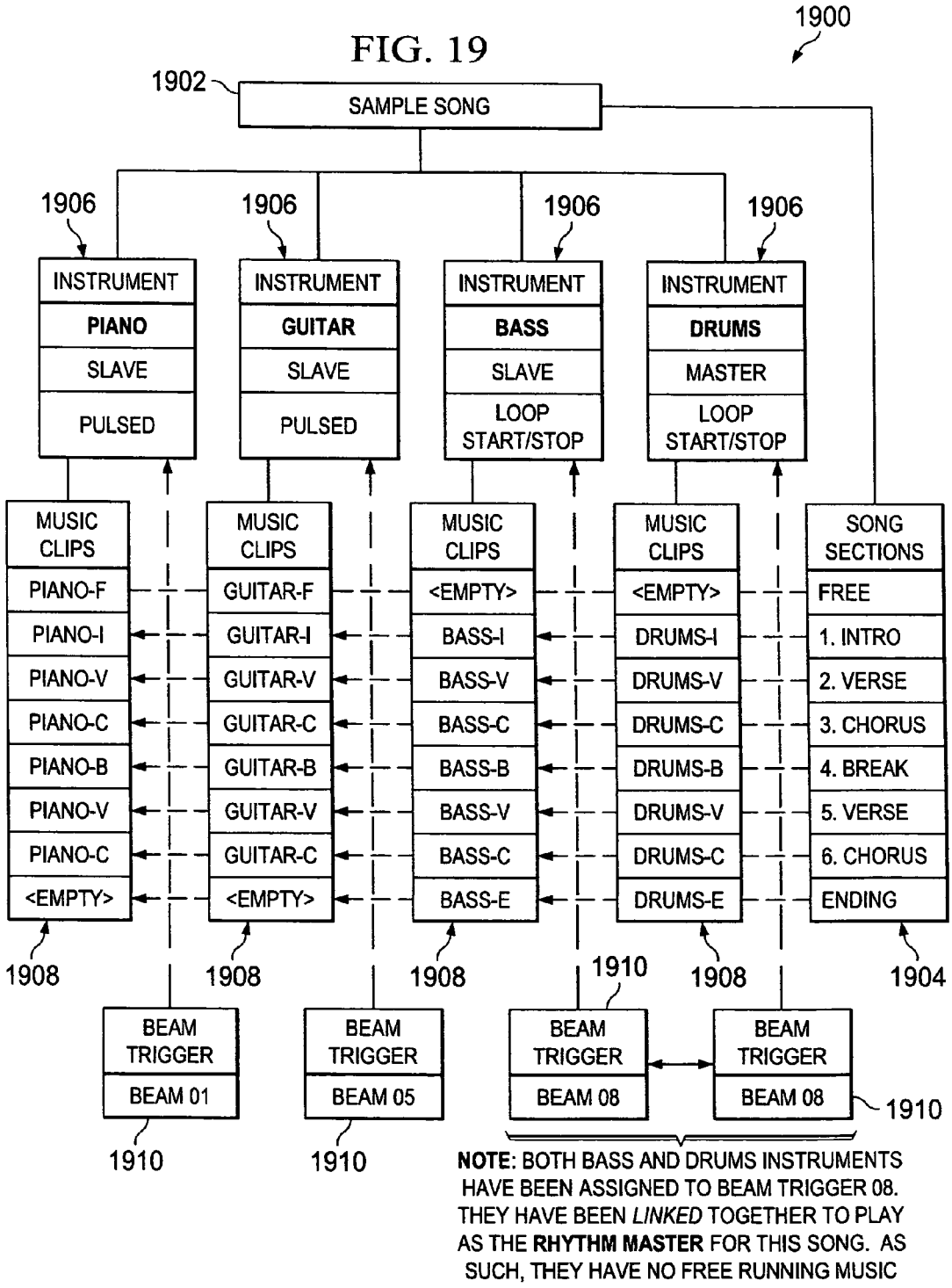
FIG. 19 is a block diagram of the structure of a Beamz Studio song from the computer's perspective.

As illustrated in FIG. 19 from the software perspective, Beamz songs are stored in memory 1204 using Beamz Studio. Each section of sample song 1902 is stored into memory 1204 by Instrument with each Instrument consisting of various Music Clips. Each Song Section 1904 lasts for a predetermined number of bars and is paired to a corresponding Music Clip for each Instrument In addition, each Instrument is paired with a specific Trigger. While sample song 1902 is playing, the Beamz Studio knows, based on the number of bars of music played, what section 1904 the song is currently in. When the user triggers the Beam Trigger, the corresponding music clip for that song section is played.

Figure 20:
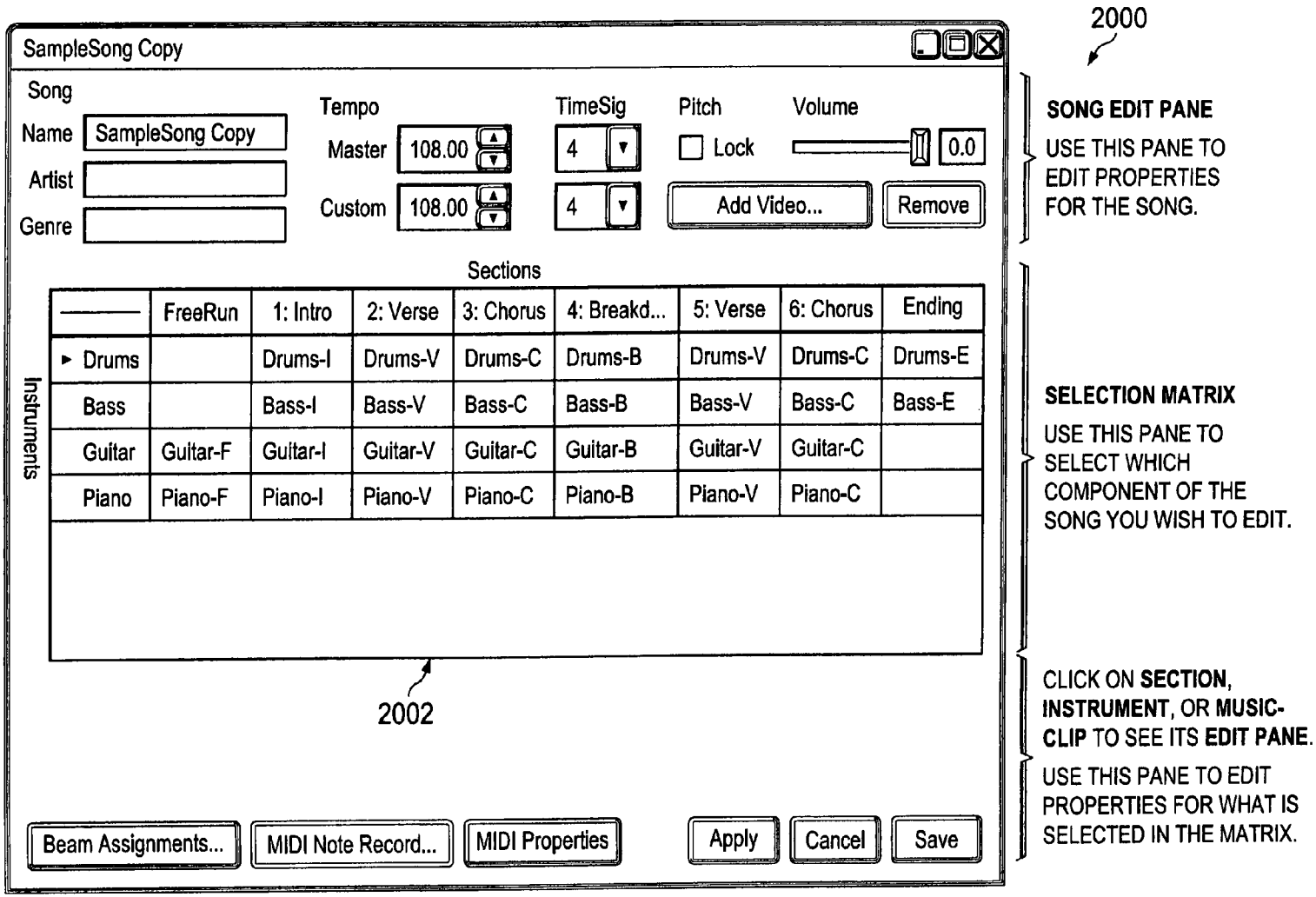
FIG. 20 is a screen capture of a Song Edit GUI.

In the Song Edit screen of the GUI, as illustrated in FIG. 20, the display width of the section columns may be resized individually or all at once using the zoom slider that is located above the Instruments side of the Matrix 2002. Any column in the matrix may be resized individually by clicking on its column boundary and dragging it to the desired width. The Edit pane Changes depending on which component is selected in the matrix. Each edit pane has its own unique set of properties that can be edited.

As illustrated in FIG. 20, the Selection Matrix 2002 displays a view of the song similar to the sample song in previous illustrations. It shows all of the song components that can be edited individually. Sections of the song are listed along the top as columns from left to right in the order they will play. Instruments are listed down the left as rows. They may be dragged up or down to any order the user chooses. Music Clips are shown across the Instrument's row under the appropriate Section column.

In order to Add, Copy or Remove sections from the song, Right Click on any Section name opens a menu with these selections.

In order to Move a Section up or down the play order sequence, Click on a Section name and drag it left or right on the Matrix. Other sections will be shifted to accommodate the change.

In order to Add, Copy or Remove Instruments from the song, Right Click on any Instrument name opens a menu with these selections.

In order to Copy a Music Clip, Click on a Music Clip and Drag it to where the user wants the copy to be placed.

In order to Remove a Music Clip from the Matrix, Right Click on any Music Clip and select Remove to empty the selected Music Clip.

In order to Select a song component for editing, Left Clicking on a Section, Instrument, or Music Clip will show its properties in the Edit pane.

As illustrated in FIG. 20, the Beam Assignments Button at the bottom of GUI 1208 opens the Beam Assignments screen where Instruments are assigned to Beam Triggers and the final mix for the song is prepared. The MIDI Properties button toggles MIDI Properties view on or off which displays the MIDI controls for the current selection. MIDI Note Record button opens a window where MIDI notes may be recorded into the selected Music Clip. The Apply button immediately applies an edit being made to a property without having to focus (click) on a different property, providing a safe way to apply a change to something. This is helpful when the user is using the Beamz controller to review the edits on the fly.

The song properties for the song may be edited whenever the song edit screen is open independent of what is selected in the matrix:

Song Name—this text entry is displayed in the Master Song List and on the main Playing screen.

Genre—this text entry is displayed in the Master Song List.

Artist—this text entry is not used anywhere else.

Time Signature—sets the music time signature for the song. Common value is 4/4.

Master Tempo—sets the default (reset) Tempo for the song in Beats Per Minute.

Custom Tempo—this control is linked to the Tempo setting on the Playing screen. Adjustments made to the tempo there are lost when the song changes unless the song is saved using the Song Edit screen.

Pitch Lock—Locks the pitch of all sounds to the tempo.

Master Volume—sets the playing Volume for the song.—can also be set in Beam Assignments screen.

Video files—clicking this allows a video file to be assigned to the song.

If Pitch Lock is selected, the pitch of all sounds being played by the instrument will be locked to the playing tempo. Using the Custom Tempo setting—which is represented on the main playing screen, the playback speed of a song may be sped up or slowed down. Since some samples used in a song may be dependent on the original tempo to play properly, the song may fall apart when the tempo is adjusted. Using Pitch Lock adjusts the playback speed to accommodate the tempo change, which can be heard as a rise or fall in pitch. MIDI files can easily accommodate a tempo change without locking the pitch, so it shouldn't be used with them. Pitch Lock is used mostly for sample-based loops.

Figure 21:
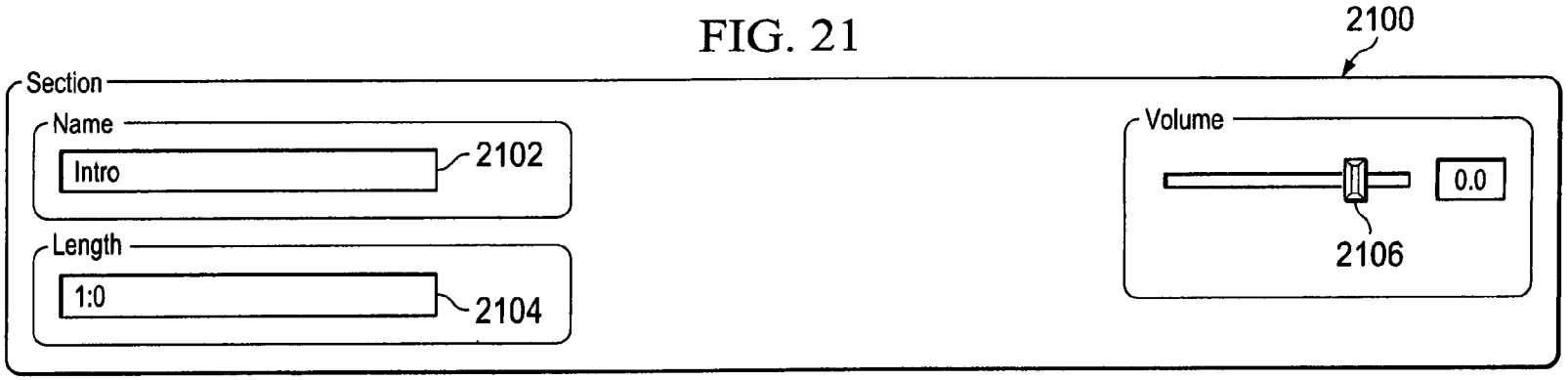
FIG. 21 is a screen capture of an Edit Song Section GUI.
Figure 22:
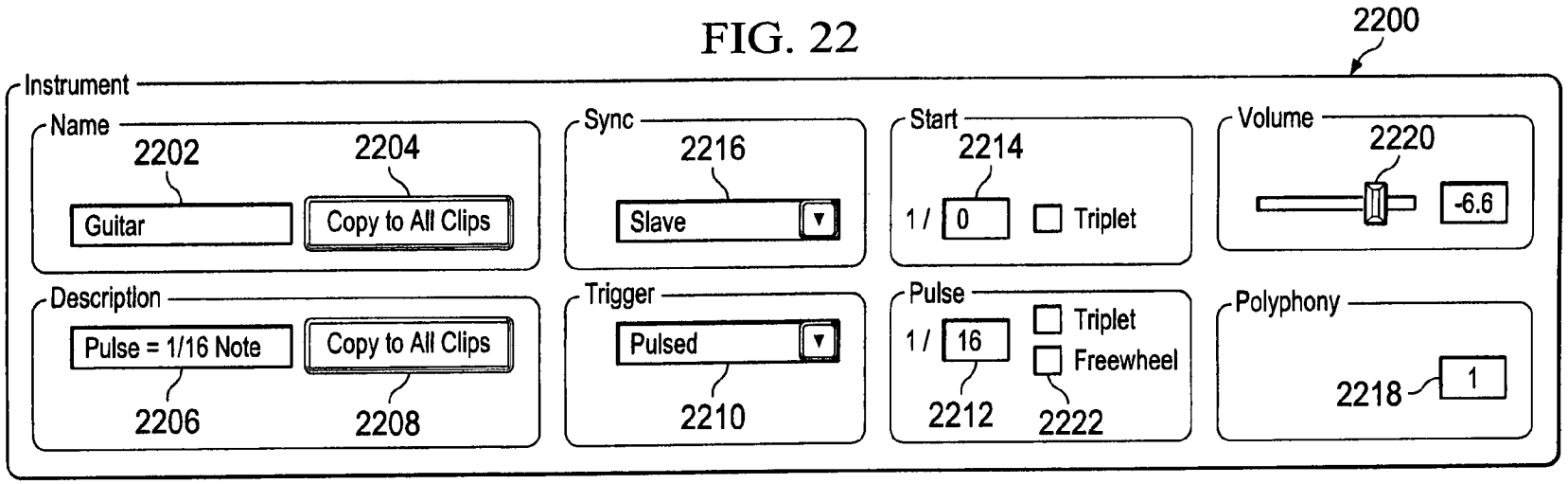
FIG. 22 is a screen capture of an Edit Instrument GUI.

In order to edit a song selection, left click on any Section name in the matrix and an edit pane will open for it at the bottom of the screen. As illustrated in FIG. 21, the Edit pane shows the three properties than can be edited for a song section:

First, Section Name 2102 can be edited. This text entry is displayed on the main Playing screen. Matching Music Clips in Sections with the same name are linked together as one when they are edited. Song sections cannot be named Free Running or Ending which are reserved names. Free Running and Ending section names cannot be edited.

Second, Section Length 2104 can be edited. Bars:Beats defines how long this section will be played by the Rhythm Master. Free Running section length cannot be edited.

Third, Volume 2106 can be edited. Volume 2106 alters the master volume while the section is being played.

It is possible in Beamz Studio to move a song section to a different spot in the playing order. Working with the arrangement of a song involves mapping out the order that the song's sections will be played. To the left of each song section's name is a number that indicates its spot on the sequential play list of the sections that a Rhythm Master will follow when the song is played. The user can move a section up or down this list by dragging it left or right to a different spot on the matrix, which will shift to accommodate the change. When a section is moved to a new spot in the play list, its Music Clips are moved along with it. Free Running and Ending sections cannot be moved because they are not part of the Rhythm Master's loop.

In order to create a new song section, Right/Click on the name of any song section. Select New Section on the menu. A new song section will be created and inserted in the matrix. Edit the new section to name it and set its length in Bars: Beats. (4 Bars=4:0). All Music Clips for the new section will be empty.

In order to clone (copy) a song section, Select the Section to copy (clone). Right/Click on its name in the matrix and select Clone Section from the menu. Cloning a Section inserts an identical copy of it into the matrix including all Music Clip assignments. All Music Clips for the new section are the same as the original (cloned) section, and are linked together for editing as long as the section has the same name as the original (see notes on Section Names below).

In order to delete a song section, Right/Click on the name of any song section. Select Delete Section on the menu. The selected song section will be removed from the matrix.

As illustrated in FIG. 20, Instruments are listed by their name and can be moved to any order by dragging them up/down in the matrix. In order to edit an instrument, left click on its name in the matrix. The Edit pane below will show the properties for it:

Name 2202 is displayed on the main Playing screen above the assigned beam when the instrument is not being controlled by a Rhythm Master. Copy to All Clips 2204 sets the Name in all the music clips for this instrument to this Name.

Description 2206 displayed on the main Playing screen below the assigned beam when the instrument is not being controlled by a Rhythm Master. Copy to All Clips 2208 sets the Description in all the music clips for this instrument to this Description.

Trigger 2210 is a pull down list with 10 choices:

1. One-Shot—plays one sound per trigger no matter how long trigger is held.
2. Pulsed—will stream sounds one at time as long as the trigger is held on. Sounds will be streamed at the rate specified in the Pulse Rate property.
3. Start/Stop—will start looping a single sound file for its specified length until another trigger stops it.
4. Swap Beams—swaps the Beam Trigger assignments for the 2 possible Beamz Units.
5. Start/Pause—works the same way as Start/Stop except when stopped, it stops in place (paused). The next time it starts, it will loop from the place where it was last stopped.
6. Momentary/Stop—works the same way as Start/Stop except it loops only while the Beam Trigger is held on.
7. Momentary/Pause—works the same way as Start/Pause except it loops only while the Beam Trigger is held on.
8. Song Advance—each time the Beam is triggered, it advances the song to the next Section.
9. Looped—future trigger feature for use in later Beamz Studio release.
10. Stop Loops—future trigger feature for use in later Beamz Studio release.

Pulse Rate 2212 sets the rate at which sounds are streamed when they are pulsed. This only applies to trigger type Pulsed. This entry is specified as musical note values. The illustration above is set for 1/16 notes. If the Triplet check box were checked, it would be 1/16 note triplets. FreeWheel 2222 locks or unlocks pulsed notes to the Master Metronome. This only applies to trigger type Pulsed.

Start 2214 sets a musical grid that is used to align or quantize triggers received by this instrument. This entry is specified as musical note values (same as Pulse Rate). This property can be used for all trigger types.

Sync 2216 is pull down list with 3 choices:

1. Master—designates this instrument as the Rhythm Master—used only with Loop Start/Stop.
2. Slave—specifies that this instrument will follow the Rhythm Master thru the song sections.
3. None—this instrument is not affected by the Master and always plays its Free Running music clips.

Polyphony 2218 specifies how many sounds can play at once when their playing overlaps. Volume 2220 can be used to adjust the overall volume for the Instrument.

The Sync 2216 property sets the relationship between this Instrument and the Rhythm Master. Some instruments are meant to play the same part throughout the entire song with no regard to which section of the song is being played by the Rhythm Master. These Instruments pay no attention to the Master at all. They always only play the Music Clips in their Free Running section. Since they will never play the Music Clips in the song sections played by the rhythm master, those clips should be empty.

There are special properties for instruments with Sync 2216 designated as Master. Since it will serve as a running metronome, an Instrument that has a Master Sync property must be a loop that is started and stopped with the trigger type Start/Stop—otherwise, it wouldn't play thru the sections. Since most Rhythm Masters provide the rhythm background (such as Bass & Drums) the sound files for these parts must prepared to loop precisely at the same tempo and time signature as the song. It is common in Beamz songs to have a Rhythm Master that is made up of more than one Instrument. Our sample song has the bass and drums as a background Master. Each is a separate Loop Start/Stop Instrument that plays a looping sample that matches the other. Both Instruments are linked together by assigning them to the same Beam Trigger that can be used to start and stop them both simultaneously. Since all Beamz songs use the right console button for running masters, both of these instruments are usually assigned to Beam Trigger 8. Only one of Instrument can be a Master-sync instrument. All other Instruments linked to it as a Rhythm Master should be Slaved to it. All Instruments used as the Rhythm Master will only play thru the song sections, so the Music Clips in their Free Running section are typically empty since they will never be played.

Likewise, there are also special properties for instruments with Sync 2216 designated as Slave. Multiple Instruments can be Slaved to the Rhythm Master. They will play the Music Clips in their Free Running pseudo section while no Master is running and controlling the song. Once the Master is running, they will only play the Music Clips that are made Active as the Master plays thru the song.

Polyphony 2218 specifies how many notes can overlap or play at one time. When a note is played on an acoustic instrument, it takes a takes a while for it to decay or quiet down. Depending on the instrument, some notes can take a long time to end. Samples of these notes are typically long enough to accommodate the entire note—including its decay. Given the interactive nature of Beamz Instruments, it is possible to trigger several notes on top of each other as they each decay.

The default setting for Polyphony 2218 is 1—which is best for most uses. In this case, if one note is still playing when another note is played on this Instrument, the first one will be cut off and only the second note will play. If another note plays before the second note finishes, it will be cut off and only the third note will be heard. For example, lead guitar notes are very long and playing more than one of them at the same time usually produces a musical train wreck. With a Polyphony 2218 setting of 1, these notes can be streamed or pulsed. When the pulsing is stopped, the last note triggered will play out to its long, long ending.

More experienced composers can use Polyphony 2218 to take advantage of the overlap by composing notes that are complimentary with each other and can play well overlapped. Polyphony allows the user to choose how many of them will be playing together. An example would be long sustained notes composed provide a chord texture to the song.

The Start 2214 property aligns the timing of triggers received by this Instrument to the metronome count. All Trigger Types 2210 can use the Start 2214 Property. Normally, an Instrument responds at the precise moment a Trigger is received from its assigned Beam. The sound produced by the instrument will be in time with the music as much or as little as the performer wants it to be—expressive timing. Most of the time, this is the way the user will want it to be. However, for some instruments, the user may want them to play perfectly in time with the Rhythm Master, which can be difficult without some practice, so the Start 2214 property was provided to offer an easy way to do this.

The normal default Start 2214 value is None which provides immediate response when a Beam is triggered. If the user chooses to use them, the Start 2214 options are specified as musical note values. The note value selected here becomes the start boundary for the instrument. When an Instrument receives a Trigger from a Beam, it will wait until it is the next "right time" to play a note of this kind as the Master metronome counts thru the song. Then, it will respond to the trigger. This assures that all triggers align with the music as was specified by the Start value that was selected. The best way to play a Beam with a specified Start 2214 value is to either trigger the Beam at the proper time musically, which produces immediate sound, or by triggering the Beam slightly ahead of time, in which case the Instrument will wait until the correct time to play a note of the selected value.

The Start 2214 property only regulates the timing of the first note when a Beam is triggered. If a trigger is held on for Pulsed Instruments, the timing of the pulsed notes is regulated by the FreeWheel 2222 property.

There are other ways to use the Start 2214 property. For example, if the instrument is set up to play a part that is meant to be played on the downbeat of a measure, a Start 2214 value of a Whole Note could be used. The performer can either play these parts directly at the proper moment, or pre-trigger them by playing slightly ahead of the downbeat and they will play on the next downbeat the metronome reaches. Common uses for this would be a One-Shot trigger type that plays an orchestra hit, or a Start/Stop trigger that starts a loop that plays along with the Rhythm Master.

FreeWheel 2222 allows pulsed notes to be pulsed Free without locking them into the metronome count. Only Pulse Trigger 2210 Types can use the FreeWheel 2222 property. If FreeWheel 2222 is not selected, a pulsed Instrument will stream notes in perfect timing with the Master metronome according to the note value selected as the Pulse Rate. The moment the Instrument first responds to the trigger is not affected by this but all subsequent pulsed notes are locked to the Master metronome on the Pulse Rate boundaries.

For Example, with a Start 2214 value of None with a Pulse Rate 2212 of ⅛, without FreeWheel 2222, the instrument may be triggered out of time, but all subsequent pulsed notes will be ⅛ notes that are in their proper note boundaries according to the Master metronome.

If FreeWheel 2222 is selected, a Pulsed Instrument will stream the notes at the intervals for the note value selected as the Pulse Rate according to the Tempo of the song. In this case the pulsed notes can freewheel from the Master metronome count and base their timing against the moment an Instrument first responds to the Beam being triggered. Freewheeled notes are all pulsed with the same timing imperfection (artistic expression) as the first note produced by the trigger—which can be regulated by the Start property.

Figure 23:
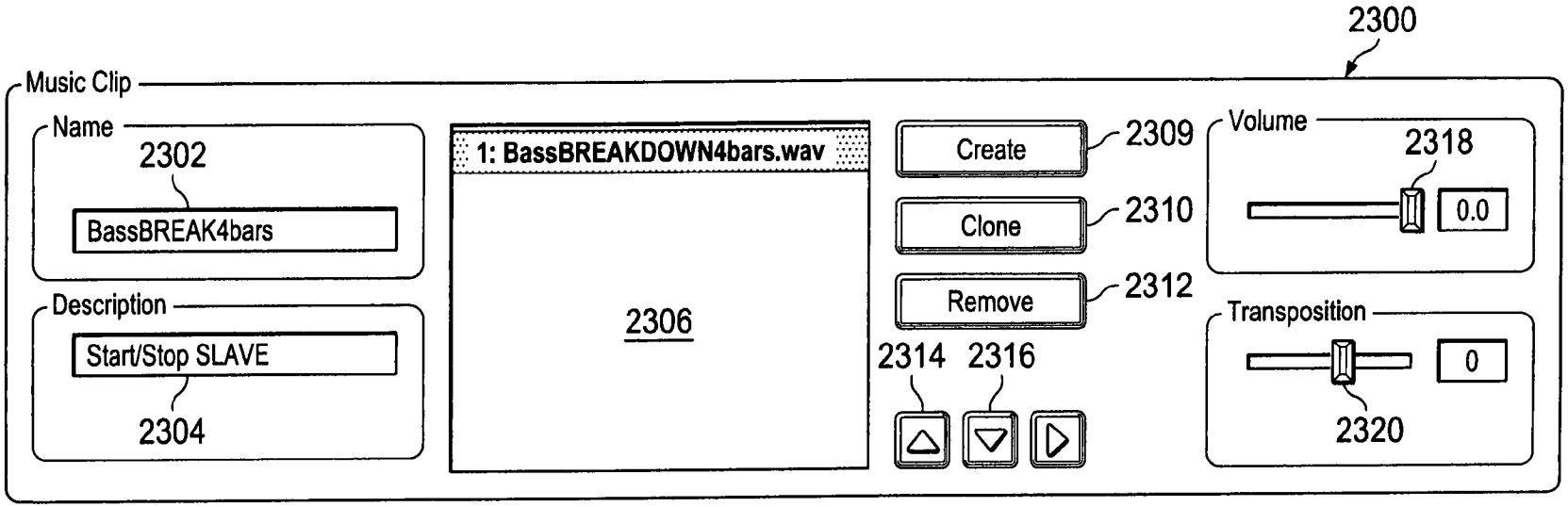
FIG. 23 is a screen capture of a Music Clip Editor GUI.

As illustrated in FIG. 23, the Music Clips Editor works with Music Clips for an Instrument. Left clicking on the name of any Music Clip will open this pane at the bottom of the screen.

The Name 2302 and Description 2304 properties are both text entry fields that serve as labels for this clip. The Name 2302 is displayed on the matrix. Both labels are displayed on the main Playing screen above and below the assigned Beam display while this clip is Active.

The Sound File Assignments Box 2306 in the center of the pane is a Play-List of all the sounds that have been assigned to this Music Clip. They are numbered in the order in which they will be play as the Music Clip steps thru its Assignments. This list can be organized by moving Assignments up or down the list.

Sound File Assignments are added to a Music Clip by clicking the Import 2308 button and opening the file to be added. Clicking the Clone 2310 button will insert an exact clone of the selected Assignment into the list below the original. Clicking the Remove 2312 button takes the selected Assignment off of the list. Clicking the Move Up 2314 or Down 2316 buttons moves the selected sound file Assignment up or down the step-thru list.

The Beamz Studio software is configured to audition sound files. In order to hear how a single sound file will play, select a single assignment and click the Play button to hear it. In order to hear how the Instrument will play all of the sounds in the Music Clip, the red button along the top of the Assignments Box 2306 works like a beam on the main screen. It can be used to hear how the Instrument will play the assignments in the box when it is triggered. It usually operates with a mouse-over like the beams on the main screen, however, if the Instrument the user is working with is a Start/Stop type, clicking on the bar will start the loop, clicking it again will stop it.

It is important to note that the Microsoft Direct Music synthesizer can only use samples in .wav file format. When a MP3 file is imported into a Music Clip, it is converted into a .wav file which is then imported and placed into the song's folder.

In order to edit sound file assignments for a music clip, if in MIDI Properties View, click the MIDI Properties button to turn it off. The user then selects the Music Clip he or she wants to work with. Select the name of a sound file in the Assignments Box 2306 to edit its properties. Volume Slider 2318 will adjust the playback volume for the selected sound file. Transpose Slider 2320 will transpose the playback for the selected sound file musically. Use the slider to transpose the selected Assignment up or down in musical steps called semi-tones. There are 12 semi-tones in one octave. When this slider is set to anything other than zero, playback for the selected sound file assignment will be transposed by the amount specified.

In order to edit MIDI properties for a music clip, the user selects the Music Clip he or she wants to work with. If not in MIDI Properties View, click the MIDI Properties button to turn it on.

Figure 24:
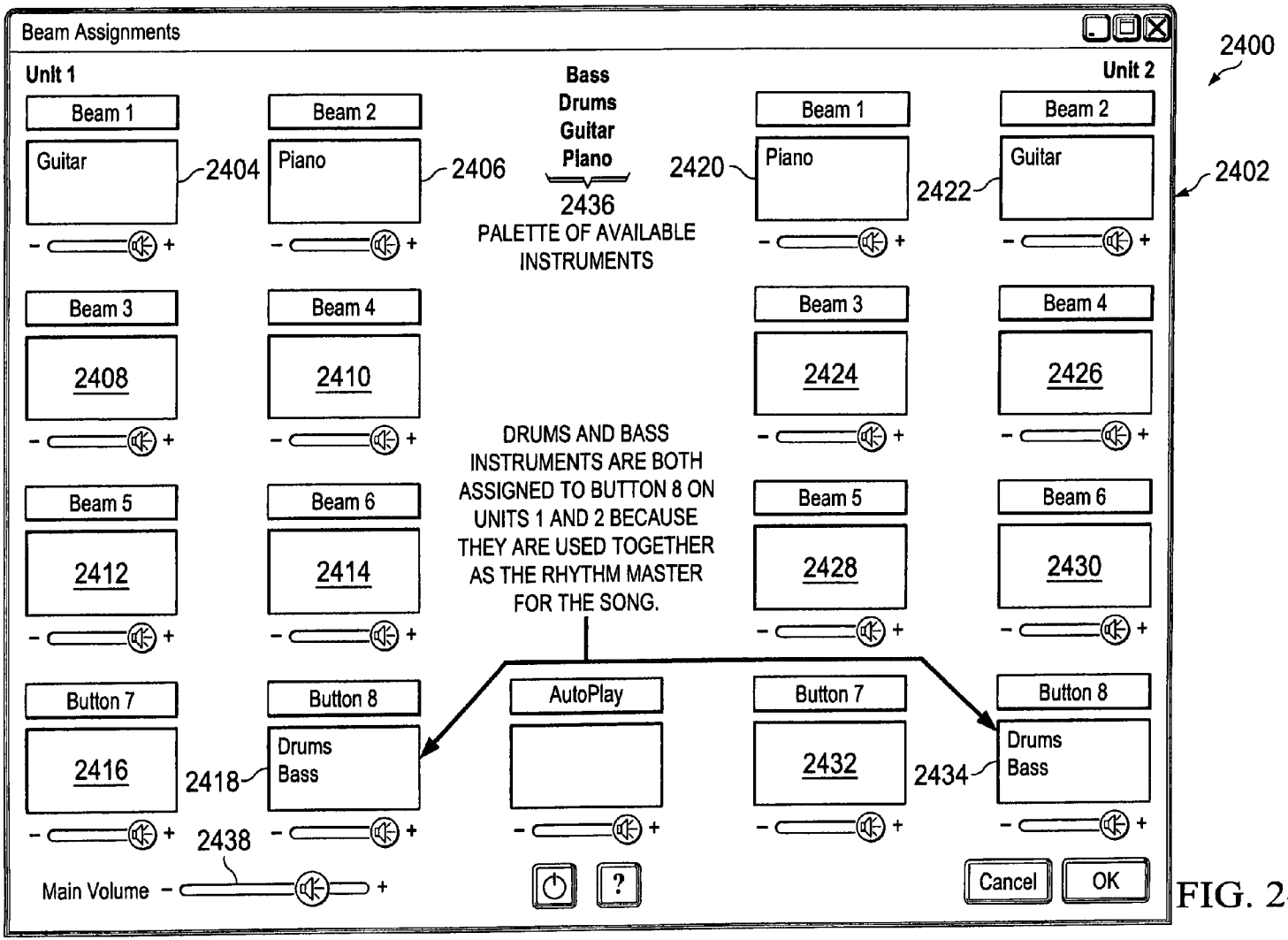
FIG. 24 is a screen capture of a Beam Assignment GUI.

The Beamz Studio software is configured to allow the user to assign instruments to beam triggers and mix the song. Click on the Beam Assignments button on the main Song Edit screen to open this screen, as illustrated in FIG. 24. The Beam Assignments 2402 screen is where Instruments are assigned to their respective Beam Triggers. It is also where the final mix of the song is prepared. Each of the possible 16 Beam Triggers (beams 1-6, button 7,8) has its own Instrument Assignments box 2404, 2406, 2408, 2410, 2412, 2414, 2416, 2418, 2420, 2422, 2424, 2426, 2428, 2430, 2432, and 2434 that contains the names of the Instruments that are assigned to it.

An Instrument is assigned to a Beam Trigger by clicking on it inside the Palette of Available Instruments 2438 and dragging it into the Assignments box for the Beam. Multiple Instruments can be assigned to the same Beam Trigger. The Instrument at the top of the stack will have its name and description displayed on the main screen. Instrument Assignments made to a Beam Trigger are removed by dragging them outside of their box.

Each Beam Trigger has a Volume Slider that will adjust its volume. The Master Volume Slider 2438 will adjust the volume of the song as a whole (this Volume Slider is also available in the Song Edit pane).

Beamz software has a special internal trigger called Autoplay that is automatically triggered one time whenever the Free Run section becomes active. Instruments used with the Autoplay trigger are either Start/Stop or One-Shot trigger types. Typically, an Autoplay instrument is a silent loop that runs in the background to establish a metronome for instruments set up to trigger on a specific Start value. Sound files can also be assigned to an Autoplay instrument. An example would be an Autoplay instrument that plays Nature sounds in the background for a Relaxation song.

The Custom Layout screen in the Tools menu is available to permit any user to rearrange the beam assignments and make their own custom mix for a Preset song. Custom Layout settings are saved as a separate file in the song folder and work as temporary overrides for the permanent settings in the song's definition file. A Custom Layout does not affect the song's definition file in any way. A song's Custom Layout is based on what is contained in its permanent song-definition file. It re-assigns or overrides the song's defined settings. Making changes to a song's definition file can have an adverse effect on its Custom Layout, so it is suggested that the user "Reset" or remove a Custom Layout before editing the definitions for a song.

It is also possible to add video to a song by Clicking the Add Video button in the Song Edit pane and open the video file to be played along with the Rhythm Runner. If the user selects a video outside of the song's folder, a copy of it will be made there. If a video has been added to a song, its name will be displayed in the video button in the Song Edit pane and the Remove button above it will be available. Click the Remove button to remove the video from the song. The copy of the video file in the user's song's folder is not removed.

Beamz Studio relies on the Microsoft GS Synthesizer, which is a part of Windows. It works only with the Microsoft WDM audio stream protocol, which is the Windows standard. Practically all factory installed sound cards for Windows computers use the protocol. However, some advanced add-on sound cards offer a selection of other protocols that used. The card used for Beamz playback must be using the WDM protocol.

Figure 25:
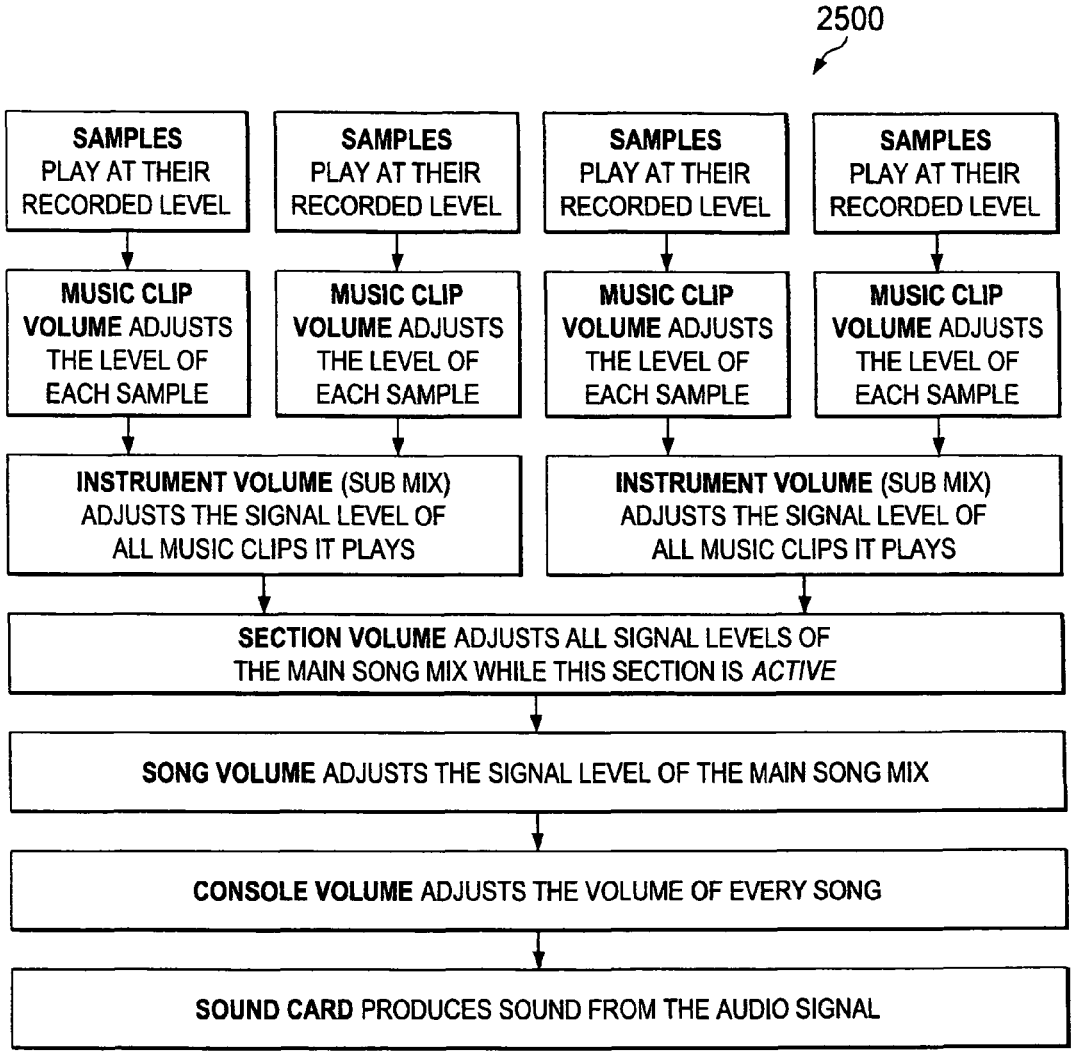
FIG. 25 is a block diagram of a sound adjustment process.

A Beamz song is a multitude of sounds that can possibly play together randomly as the performer chooses. Getting them all to play at a consistent volume throughout an entire song can be challenging. When a sound file plays, the sound it produces begins along a path thru the Beamz software and ultimately ends up at the final destination: the computer's sound card, where it can be heard. As the sound travels along its path thru the Beamz software, there are several places where its volume can be adjusted along the way. The sound is adjusted at several places along its path to the sound card, as illustrated by FIG. 25.

All Volume sliders in Beamz Studio can only lower the volume, not boost it on its path to the sound card. This amount is displayed as a decibel value (−3.0 would be reducing the volume by 3 decibels).

The Beamz Studio software is configured to allow a user to mix a song by following these steps:

1. Use the Volume Slider in the Music Clip edit pane to fine tune each sound's volume across all sounds for each Instrument. They should all play at the same level.

1a. For Music Clips with MIDI properties, the volume and panning can also be adjusted there.

2. Use Volume Slider in the Instrument edit pane to set a similar level for all Instruments in the song.
3. Use the individual Volume Sliders in the Beam Assignments screen to tune the overall mix for the song.
4. If certain song sections are to be quieter than others, use the Volume Slider in the Section edit pane to adjust the master mix down while the section is being played.
5. Use the Volume Slider in the Beam Assignments screen or the Song Edit pane to adjust the Master volume to match other songs.

The Beamz Studio software is also configured with various MIDI features. These features include playing MIDI files with the Beamz internal speakers, playing MIDI files using an external synthesizer, and triggering Beamz instruments with an external MIDI keyboard.

In order to play MIDI files with the Beamz internal speakers, the user will follow the following steps: first, import the MIDI file into a Music Clip and Select it; second, if needed, assign a Step Interval for the Instrument; third, open the MIDI properties view; fourth, select the DLS collection and Patch (Instrument) for each channel listed in the grid; and fifth, close the MIDI properties view and use the play-bar in the Music Clips editor to hear how it sounds. If the user does not want to use the MIDI channels that are listed, he can override them and use a different MIDI channel by selecting it in the Use ch pull down selection.

In order to play MIDI files using an external synthesizer, the user will follow the following steps: first, import the MIDI file into a Music Clip and Select it; second, if needed, assign a Step Interval for the Instrument; third, Open the MIDI Properties view by clicking on the MIDI Properties button; fourth, Select the MIDI port that has the external sound device connected to it; and fifth, Close the MIDI Properties view and use the play-bar in the Music Clips editor to hear how it sounds.

Figure 26:
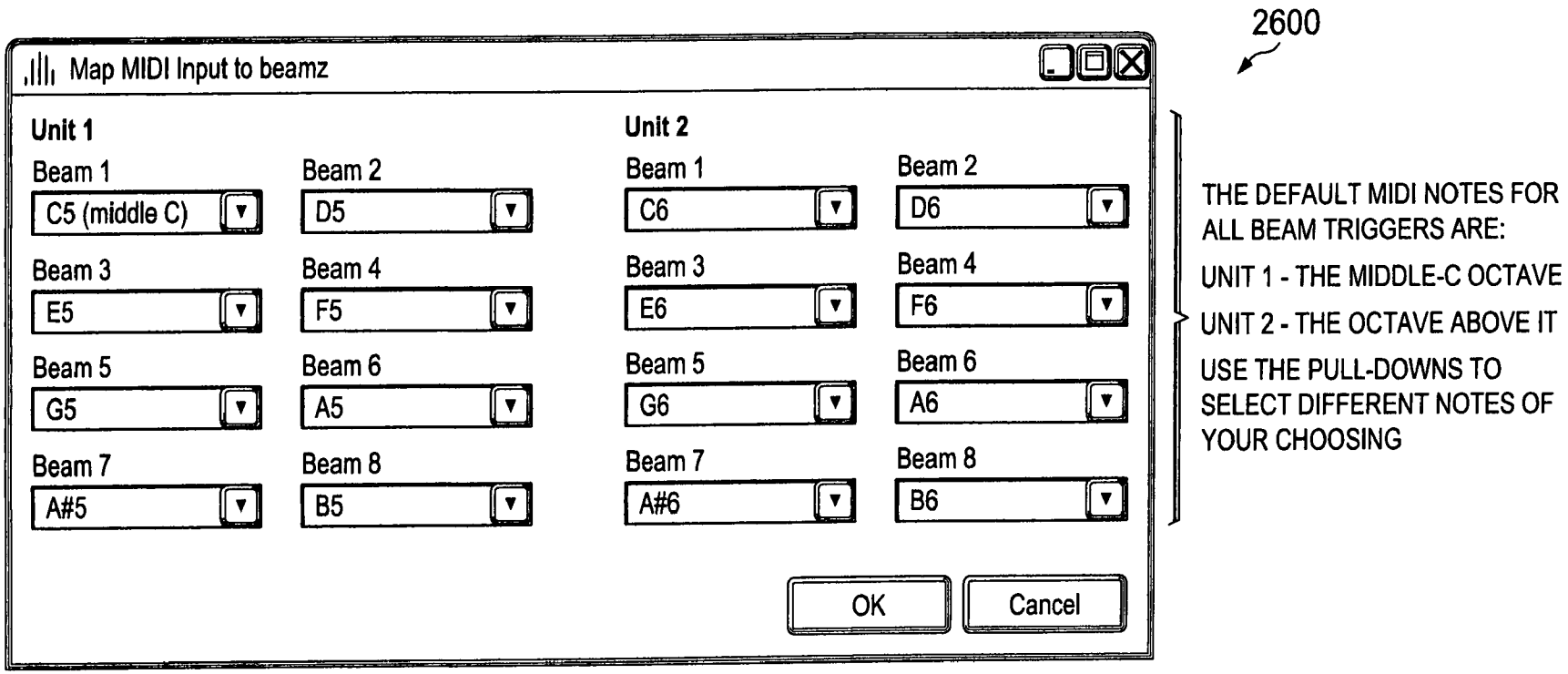
FIG. 26 is a screen capture of a Map MIDI Input to Beams GUI.

In order to trigger Beamz Instruments with an external MIDI keyboard, the user will connect a MIDI keyboard connected to a MIDI Input port on the user's computer and map Instruments to be triggered by selected keys (MIDI notes) on the keyboard. As illustrated in FIG. 26, Open the Tools Menu and select Map MIDI Input to Beams. The default MIDI notes for all Beam Triggers are: Unit 1—the middle C octave and Unit 2—the octave above it. Use the pull-downs to select different notes of the user's choosing.

Figure 27:
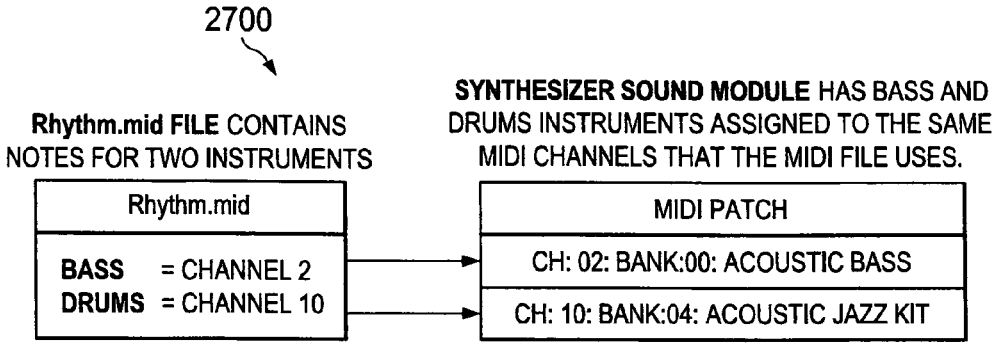
FIG. 27 is a block diagram of how MIDI files play their sounds on a MIDI sound device.

A MIDI file is a collection on Notes that will be produced by a synthesizer when the MIDI sequence is played. Each Instrument being "played" by the MIDI file will have its own unique MIDI channel used for its notes, and the sound device intended to produce the sound must have the appropriate (matching) Instrument assigned to the same MIDI channel. Each instrument must have its own unique MIDI channel, and its up to the composer to map the MIDI channels that are used in a song, as illustrated in FIG. 27.

When Rhythm.mid is played, it sends notes to the synthesizer on 2 MIDI channels. MIDI synthesizers keep their internal collection of Instruments organized in Banks. Each Bank contains the programming and samples to play a selection of different Instruments. Most synthesizers have a special General MIDI Bank that is a standardized collection of all major Instruments.

Note: Channel 10 is recognized by General MIDI Standards as being used for drums & percussion sounds, which are treated differently by most synthesizers. Some synthesizers display only a list of drum kits as Instrument choices for MIDI channel 10.

Beamz software uses the Microsoft DirectMusic synthesizer to play its MIDI files. Instead of being contained in memory banks, the Instrument (patches) used by this synthesizer are contained in DLS Collections which are files on the hard disk of the user's computer.

Figure 28:
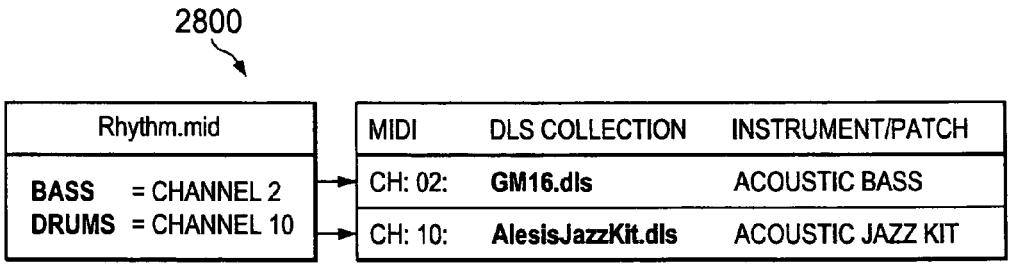
FIG. 28 is a block diagram of how MIDI files are played in Beamz Studio.

The same MIDI sequence played in Beamz Studio is illustrated in FIG. 28. Just as it is with any MIDI sound module, each MIDI channel used in the file being played must be assigned to an Instrument or Patch within a DLS collection in order to produce sound. The Microsoft DirectMusic synthesizer has its own DLS version of the General MIDI collection, which is uses as a default until something else is assigned.

The Beamz Studio software is also configured to assign (DLS) Sounds to MIDI files used in Music Clips, using the following steps: first, click on the MIDI Properties Button to "turn on" the MIDI view—click again to turn it off; and second, use the MIDI Properties View to assign DLS Instruments for the selected Music Clip.

Figure 29:
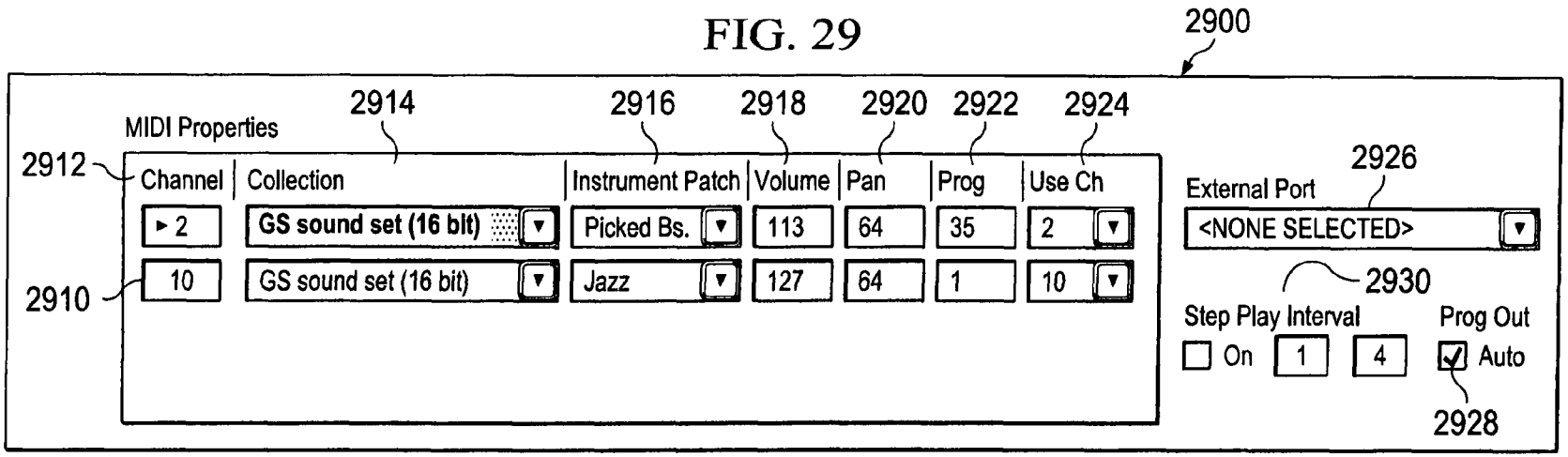
FIG. 29 is a screen capture of a MIDI Properties GUI.

As illustrated in FIG. 29, each MIDI channel being used by the selected Music Clip is listed on the grid in the left column 2910. If the Music Clip contains assignments for multiple MIDI files, all of the channels they use will be listed in the grid. Each row in the grid represent a MIDI Instrument used by the selected Music Clip where the user can assign a MIDI synthesizer sound to be used for it. The user can also set the MIDI volume and MIDI panning controls.

Channel 2912 is a display of the channel embedded in a MIDI file used by the Music Clip.

DLS Collection 2914 will contain a list of the DLS Collections that have already been imported into the song. The normal default is the General MIDI collection that comes with the Microsoft DirectMusic synthesizer. If the one the user wants to use is not listed, he must Import it by selecting Import DLS Collection. This opens a browser window where he can select the .dls file he wants to Import.

DLS Instrument 2916 will contain a list of all the Instruments contained in the selected DLS Collection.

MIDI Volume 2918 sets the MIDI volume control for this MIDI channel. MIDI controller # 7 (1-127).

MIDI Pannning 2920 sets the MIDI panning control for this MIDI channel. MIDI controller # 10 (1-65-127).

Prog (number) 2922 sets a MIDI Program Change controller value to be sent to an external MIDI device each time the Music Clip becomes active This is only available if a MIDI Outport Port has been selected and the Auto-Send option is used.

Use ch 2924 sets an over-ride MIDI channel to be used instead of what's in the MIDI file itself. The Channels listed at the left of the grid represent what's being used within the MIDI (.mid media) for the selected Music Clip. This applies to not only the internal DLS assignment, but it also applies to MIDI output being sent to external MIDI devices. If this conflicts with another MIDI Instrument the user has setup somewhere else in the song, it can be changed by using the pull down to select a different channel.

In Beamz Studio, each instrument has certain MIDI properties.

External Port 2926 selects the output port to be used for sending the MIDI that is played by this Instrument to an external MIDI synthesizer.

Auto-Send MIDI Out 2928 indicates whether or not the user wants to send Program, Volume & Panning controllers to the external synthesizer when each Music Clip becomes active.

Step Play Interval 2930 allows MIDI files for this Instrument to be stepped thru for a specified duration each time they are played.

Figure 30:
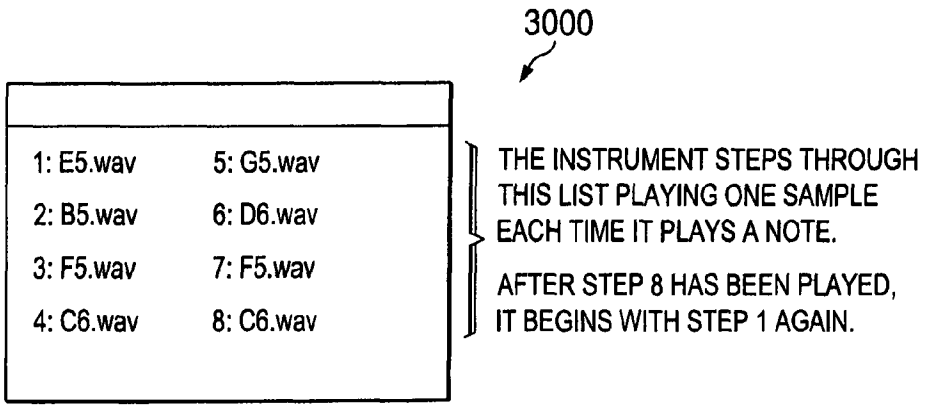
FIG. 30 is a screen capture of a Click to Play GUI.

Beamz Studio is also configured to use the Step Play Interval with MIDI files. When Step Play Interval is selected for an Instrument, it steps thru a MIDI file each time the Music Clip needs a sound to play (instead of stepping thru the list of sound file assignments). The Step Interval indicates how far it should "play" into the MIDI file each time it advances, as illustrated in FIG. 30.

Figure 31:
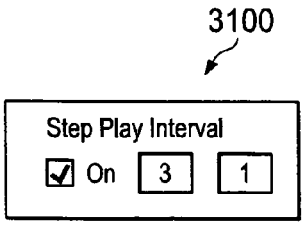
FIG. 31 is a screen capture of a Step Play Interval GUI.

Preparing a separate MIDI file for each of these notes would be a lot of work. The Step Interval option provides an easier way to prepare these MIDI notes. The Step Play Interval option only works with MIDI files—it is ignored with any other type of media file. When Step is selected, as illustrated in FIG. 31, it applies to all MIDI files played by the Instrument. The number on the left (3) is the multiplier. The number on the right (1) is the note value (1=whole; 16=16th note, etc.). In FIG. 31, the Step Play Interval would be 3 Bars.

MIDI Note Record offers a convenient way to play simple MIDI notes directly into the selected Music Clip from the user's MIDI keyboard without having to use sequencing software to put them into a MIDI file first, then Import them. It does not work like Step Recording in MIDI sequencing software. Every note on the list will have the selected note duration—no matter how quickly they are played or how long they are sustained on the keyboard. When multiple notes are played on the keyboard, they are all quantized together as a chord, and they are all listed as one entry on the list. When the user clicks Add to Clip, each entry on the list becomes a separate MIDI file in the Music Clip where they can easily be cloned, removed, or moved to a new spot on the assignments list.

Figure 32:
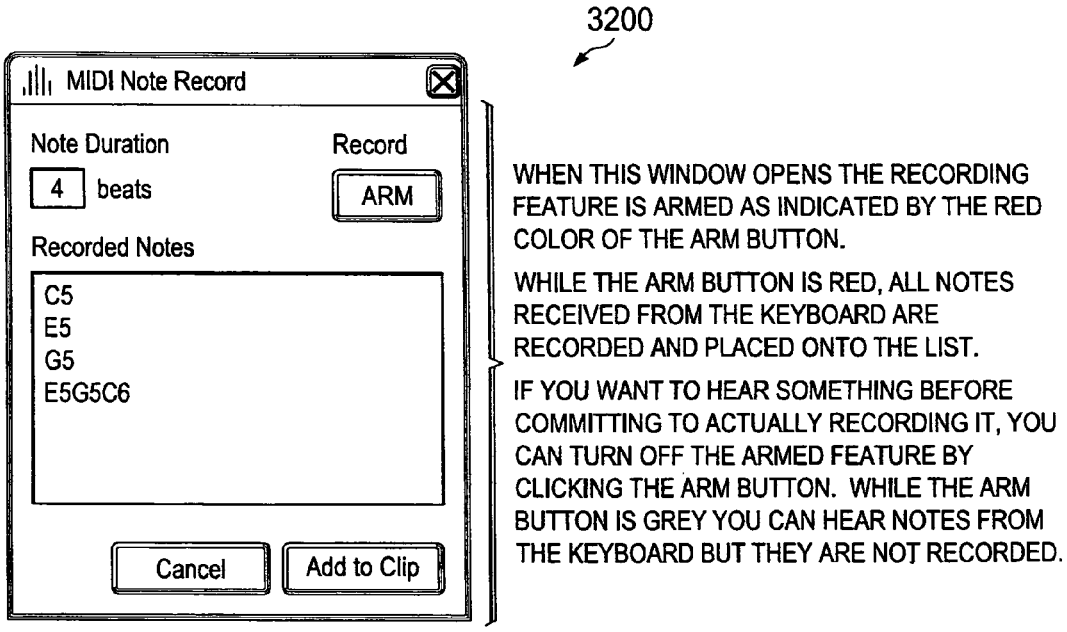
FIG. 32 is a screen capture of a MIDI Note Record GUI.

The Beamz Studio software is configured to allow the user to record his own MIDI notes into a Music Clip, by following these steps, as illustrated in FIG. 32. First, Select the Music Clip where you want the notes to be placed. Second, Click the MIDI Note Record button to open up this window and to begin a recording session. Third, Set the Note Duration for the notes you intend to play into the Music Clip. Fourth, Play the notes individually on the user's MIDI keyboard (each note you play is added to the box). Fifth, When the user is finished adding all notes to the list, click Add To Clip.

As part of Beamz Studio, a collection of our best Instrument DLS files have been assembled and placed on a single CD-ROM that is shipped along with the software. It is a single library where the user can easily find a quality instrument sound as an alternative to the sometimes lower quality instruments contained in the General MIDI collection. This is a sampling of the DLS instruments that our in house composers use to deliver the full, rich sounds in the Preset songs. Use Windows Explorer to copy all or part of this library to a place on the user's computer where it will be easy to browse thru when the user is looking for that perfect instrument When the user Imports a DLS file from this library into a song, a copy of it is made and placed into the song's folder.

Although applicant has described applicant's preferred embodiments of the present invention, it will be understood that the broadest scope of this invention includes such modifications as diverse shapes, sizes, and materials. Further, many other advantages of applicant's invention will be apparent to those skilled in the art from the above descriptions, including the drawings, specification, appendix, and all other contents of this patent application and the related provisional patent applications.

What is claimed is:

1. A music instrument configured to allow a user to compose interactive musical sounds, comprising:

a plurality of triggers configured to be controlled by a user;

a processor configured to be controlled by a graphical user interface ("GUI");

a controller responsive to the plurality of triggers, and configured to generate control signals as a function of the triggers selected by the user;

a plurality of music programs, wherein each said music program is mapped and composed into related components and configured to play sympathetic sounds in real time, the processor configured to generate an electronic signal as a function of the controller control signals and the related components of the plurality of mapped and composed music programs; and at least one sound generator configured to generate the sympathetic sounds as a function of the related components of the mapped and composed music programs.

2. The music instrument as specified in claim 1 wherein the GUI is configured to be responsive to a variety of peripheral inputs.

3. The music instrument as specified in claim 2 wherein the peripheral input is a keyboard.

4. The music instrument as specified in claim 2 wherein the peripheral controlled input is a mouse.

5. The music instrument as specified in claim 2 wherein the peripheral controlled input is a touch-screen display.

6. The music instrument as specified in claim 2 wherein the triggers are configured to be controlled by the GUI.

7. The music instrument as specified in claim 6 wherein the GUI is configured to be controlled by the peripheral inputs.

8. The music instrument as specified in claim 7 wherein the peripheral inputs are configured to be controlled by the user's finger.

9. The music instrument as specified in claim 8 such that the plurality of triggers can be simultaneously controlled by the user's fingers.

10. The music instrument as specified in claim 1 wherein the audible musical sounds are sympathetic both rhythmically and chromatically.

11. The music instrument as specified in claim 1 wherein the audible musical sounds comprise a plurality of pre-composed musical notes.

12. The music instrument as specified in claim 11 wherein the plurality of pre-composed musical notes may be played at any point in time.

13. The music instrument as specified in claim 1 wherein when one of the triggers is in a first state for a prolonged period of time successive said musical sounds are generated.

14. The music instrument as specified in claim 13 wherein the successive audible musical sounds are sympathetic both rhythmically and chromatically.

15. The music instrument as specified in claim 1 wherein the sound generator is a synthesizer.

16. The music instrument as specified in claim 1 wherein the controller comprises a trigger circuit configured to determine when the triggers have changed state.

17. The music instrument as specified in claim 1 wherein each said music program comprises sound elements.

18. The music instrument as specified in claim 17 wherein the sound elements of each said music program comprise a subset of a musical composition.

19. The music instrument as specified in claim 18 wherein the sound elements of each said music program are correlated to each other.

20. The music instrument as specified in claim 19 wherein the musical composition is a subset of a song.

21. A computer readable medium including instructions for enabling a user to compose interactive musical sounds, comprising:

instructions enabling a user to control a plurality of triggers;

instructions enabling a processor to be controlled by a graphical user interface ("GUI");

instructions enabling a controller to be responsive to the plurality of triggers and to generate control signals as a function of the triggers selected by the user;

instructions enabling interaction with a plurality of music programs, wherein each said music program is mapped and composed into related components and configured to play sympathetic sounds in real time, whereby the processor can generate an electronic signal as a function of the controller control signals and the related components of the mapped and composed music programs; and instructions enabling at least one sound generator to be configured to generate the sympathetic sounds as a function of the related components composed music programs.

22. The computer readable medium music instrument as specified in claim 21 further including instructions enabling the GUI to be responsive to different types of peripheral inputs.

23. The computer readable medium as specified in claim 22 further including instructions enabling the GUI to be responsive to a keyboard.

24. The computer readable medium as specified in claim 22 further including instructions enabling the GUI to be responsive to a mouse.

25. The computer readable medium as specified in claim 22 further including instructions enabling the GUI to be responsive to a touch-screen display.

26. The computer readable medium as specified in claim 22 further including instructions enabling the triggers to be controlled by the GUI.

27. The computer readable medium as specified in claim 26 further including instructions enabling the GUI is configured to be controlled by the peripheral inputs.

28. The computer readable medium as specified in claim 27 further including instructions enabling the GUI to be controlled by the user's finger.

29. The computer readable medium as specified in claim 28 further including instructions enabling the plurality of triggers to be simultaneously controlled by the user's fingers.

30. The computer readable medium as specified in claim 21 further including instructions enabling the audible musical sounds to be sympathetic both rhythmically and chromatically.

31. The computer readable medium as specified in claim 21 further including instructions enabling the audible musical sounds to comprise a plurality of pre-composed musical notes.

32. The computer readable medium as specified in claim 31 further including instructions enabling the plurality of pre-composed musical notes to be played at any point in time.

33. The computer readable medium as specified in claim 21 further including instructions enabling successive said audible musical sounds to be generated when one of the triggers is in a first state for a prolonged period of time.

34. The computer readable medium as specified in claim 33 further including instructions for enabling the successive audible musical sounds to be sympathetic both rhythmically and chromatically.

35. The computer readable medium as specified in claim 21 further comprising instructions enabling the sound generator to be a synthesizer.

36. The computer readable medium as specified in claim 21 further comprising instructions enabling the controller to operate as a trigger circuit configured to determine when the triggers have changed state.

37. The computer readable medium as specified in claim 21 further comprising instructions enabling each said music program to comprise sound elements.

38. The computer readable medium as specified in claim 37 further comprising instructions enabling the sound elements of each said music program to comprise a subset of a musical composition.

39. The computer readable medium as specified in claim 38 further comprising instructions enabling the sound elements of each said music program to be correlated to each other.

40. The computer readable medium as specified in claim 39 further comprising instructions enabling the musical composition to be a subset of a song.

* * * * *

UNITED STATES PATENT AND TRADEMARK OFFICE

CERTIFICATE OF CORRECTION

PATENT NO. : 8,178,773 B2
APPLICATION NO. : 12/586885
DATED : May 15, 2012
INVENTOR(S) : Gerald Henry Riopelle and Gary Bencar It is certified that error appears in the above-identified patent and that said Letters Patent is hereby corrected as shown below:

On the Title Page, Item (73) Assignee: Beamz Interaction, Inc should be changed to -- Beamz Interactive, Inc. --

Signed and Sealed this
Thirty-first Day of July, 2012

David J. Kappos

David J. Kappos
*Director of the United States Patent and Trademark Office*